US008540607B2

(12) United States Patent
Kissel et al.

(10) Patent No.: US 8,540,607 B2
(45) Date of Patent: Sep. 24, 2013

(54) VARIABLE RESISTANCE SYSTEM

(75) Inventors: Robert M. Kissel, Lithia, FL (US); Edward G. Eubanks, St. Peters, MO (US); James M. Houston, Evergreen, CO (US); Scott A. Dye, Morrison, CO (US); Dale A. Schoonover, Louisville, CO (US); Michael R. Cottrell, Arvada, CO (US)

(73) Assignee: Exerton, LLC, Chesterfield, MO (US)

( * ) Notice: Subject to any disclaimer, the term of this patent is extended or adjusted under 35 U.S.C. 154(b) by 0 days.

(21) Appl. No.: 13/229,928

(22) Filed: Sep. 12, 2011

(65) Prior Publication Data

US 2012/0004075 A1 Jan. 5, 2012

Related U.S. Application Data

(60) Division of application No. 11/856,880, filed on Sep. 18, 2007, now Pat. No. 8,016,725, which is a continuation-in-part of application No. 10/688,251, filed on Oct. 17, 2003, now abandoned.

(51) Int. Cl.
*A63B 71/00* (2006.01)

(52) U.S. Cl.
USPC ..... 482/5

(58) Field of Classification Search
USPC ..... 482/4, 5, 8, 9, 93, 98, 99
See application file for complete search history.

(56) References Cited

U.S. PATENT DOCUMENTS 4,746,113 A 5/1988 Kissel
4,811,946 A * 3/1989 Pelczar ..... 482/5
4,822,034 A 4/1989 Shields
4,834,365 A 5/1989 Jones
4,836,536 A 6/1989 Jones
4,911,435 A 3/1990 Johns
4,921,244 A 5/1990 Berroth
4,971,305 A 11/1990 Rennex
5,037,089 A * 8/1991 Spagnuolo et al. ..... 482/5
5,074,551 A * 12/1991 Olschansky et al. ..... 482/137
5,100,128 A 3/1992 Mabry
5,314,394 A 5/1994 Ronan
5,328,429 A 7/1994 Potash
5,350,344 A 9/1994 Kissel
5,407,403 A 4/1995 Coleman
5,431,609 A 7/1995 Panagiotopoulos
5,556,362 A 9/1996 Whipps
5,643,151 A 7/1997 Naimo
5,655,997 A 8/1997 Greenberg
5,785,632 A * 7/1998 Greenberg et al. ..... 482/5
5,993,356 A 11/1999 Houston
6,015,367 A 1/2000 Scaramucci (Continued)

*Primary Examiner* — Loan Thanh
*Assistant Examiner* — Sundhara Ganesan
(74) *Attorney, Agent, or Firm* — CreatiVenture Law, LLC; Dennis JM Donahue, III

(57) ABSTRACT

A method and apparatus for providing variable resistance in connection with exercise equipment uses vertically oriented weight plates that rare in a side-by-side arrangement and are selected by selectors in a selector assembly. A set of actuators are controlled by a computer processor and force the selectors into positions that engage and disengage with a corresponding set of weights. The computer is connected to a user interface that accepts input from a user and instructs the computer to adjust the amount of weight using the actuators and the corresponding selectors. The computer is also in communication with sensors that indicate whether the weights have been lifted successfully and automatically select a lower weight when the weights are not lifted successfully.

19 Claims, 21 Drawing Sheets

(56) References Cited

U.S. PATENT DOCUMENTS

| | | | | |
|---|---|---|---|---|
| 6,045,491 | A | 4/2000 | McNergney | |
| 6,117,049 | A | 9/2000 | Lowe | |
| 6,174,265 | B1 | 1/2001 | Alessandri | |
| 6,224,519 | B1 | 5/2001 | Doolittle | |
| 6,436,058 | B1 | 8/2002 | Krahner | |
| 6,468,189 | B2 | 10/2002 | Allesandri | |
| 6,494,811 | B1 | 12/2002 | Allesandri | |
| 6,582,345 | B2 | 6/2003 | Roy | |
| 6,626,805 | B1 | 9/2003 | Lightbody | |
| 6,632,159 | B1 | 10/2003 | Slattery | |
| 6,632,161 | B1 | 10/2003 | Nir | |
| 7,011,611 | B1 | 3/2006 | Ripley | |
| 7,077,791 | B2 | 7/2006 | Krull | |
| 7,485,076 | B2 | 2/2009 | Lee | |
| 7,534,199 | B2 | 5/2009 | Krull | |
| 7,553,265 | B2 | 6/2009 | Crawford | |
| 7,614,982 | B2 | 11/2009 | Crawford | |
| 7,794,373 | B2 | 9/2010 | Crawford | |
| 8,016,725 | B2 * | 9/2011 | Kissel et al. | 482/5 |
| 2003/0153439 | A1 * | 8/2003 | Krull | 482/99 |

* cited by examiner

VARIABLE RESISTANCE SYSTEM

CROSS-REFERENCE TO RELATED APPLICATIONS

This application is a divisional of U.S. patent application Ser. No. 11/856,880 filed on Sep. 18, 2007, issued as U.S. Pat. No. 8,016,725, which is a continuation-in-part of U.S. patent application Ser. No. 10/688,251 which was filed on Oct. 17, 2003.

STATEMENT REGARDING FEDERALLY SPONSORED RESEARCH

Not Applicable.

APPENDIX

Not Applicable.

BACKGROUND OF THE INVENTION

1. Field of the Invention

The present invention relates to variable resistance systems, and more particularly, to an automatically adjustable system that is useful in providing variable resistance in exercise equipment.

2. Related Art

It is known that, for maximum benefit, an athlete in training must push himself to his maximum strength limits. This is difficult to achieve with conventional weight training equipment such as a bench press machine or other general purpose or special purpose machines since generally the athlete has heretofore stopped exercising when he reaches his first point of momentary muscular failure (MMF). At that point, the athlete must either personally change the weight on the machine he is using, or a second person must change the weight for him so that the athlete can continue using the machine. This either unnecessarily interrupts the exercise, or requires the continual presence of a second, non-exercising partner. If the athlete were able to experience multiple MMF's during any one set of specific exercise, he would eventually reach his absolute fatigue point (AFP). However, with conventional exercise equipment, the AFP is extremely difficult or impossible to reach due to the drawbacks described above.

Consider the case of an athlete lifting 120 pounds while doing bench presses. In this exercise, direct resistance is placed upon pectoral major and anterior deltoids. Soon, for example after only ten complete repetitions, this athlete is no longer able to complete another repetition. As a direct result, he stops exercising, even though he would be able to continue exercising at a lower weight amount, and ultimately reach his AFP.

Weight stacks of conventional exercise machines generally include a number of identical weight plates, or optionally include some smaller weights of a second value at the top of a stack, or which can be manually connected to the weight stack. Changing the weight resistance automatically in such a system can be complicated and expensive. For example, one possible approach is to provide individual automatically actuable selector pins for each plate that can be chosen as needed to choose the desired weight for the stack at that point in the exercise. Alternatively, a movable pin or pins can travel along the weight stack to the desired position for selecting the proper resistance. An exercise machine described in coassigned U.S. patent application Ser. No. 10/688,251, the entire specification of which is hereby incorporated by reference, utilizes actuators to select vertically oriented weight plates by pressing a tang into a recess.

SUMMARY OF THE INVENTION

The present invention provides a variable resistance system for an exercise machine that permits and controls the automated changing of weight resistance without interrupting the exercise of the machine's user. In a preferred embodiment of the invention, the mechanism that selects the weights to be lifted is not in physical contact with the mechanism that actuates the selector mechanism. A system for providing variable resistance to exercise equipment has hooks that engage various weight plates. The hooks are actuated to engage or disengage such weight plates by using magnets, thereby avoiding direct physical contact between the selecting mechanism, which moves with the selected weight plates, and the actuating mechanism, which is electrically connected to a controller. In one embodiment a user interface console provides multiple options to a user and directs the controller to automatically cause the weight lifted to increase or decrease based on multiple factors.

Accordingly, in furtherance of the above advantages and goals, the invention is, briefly a variable resistance system comprising a resistance providing member, an actuator, and a selector assembly, wherein the actuator actuates the selector assembly to selectively engage or disengage the resistance providing member by applying a force on the selector assembly or by removing a force from the selector assembly. According to the invention, movement of the selector assembly is dissociated from the position of actuator.

Furthermore the invention provides for a method of providing variable resistance comprising the steps of providing a plurality of resistance providing members, defining a successful repetition as characterized by satisfying a criteria, selecting a first set of resistance providing members having a first total resistance, and selecting a second set of resistance providing members having a second total resistance after a repetition that does not satisfying the criteria, wherein the second total resistance is less than the first total resistance.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

Throughout the figures like parts are indicated by like element numbers.

DETAILED DESCRIPTION OF THE PREFERRED EMBODIMENTS

The following description of the preferred embodiment(s) is merely exemplary in nature and is in no way intended to limit the invention, its application, or uses.

Figure 1:
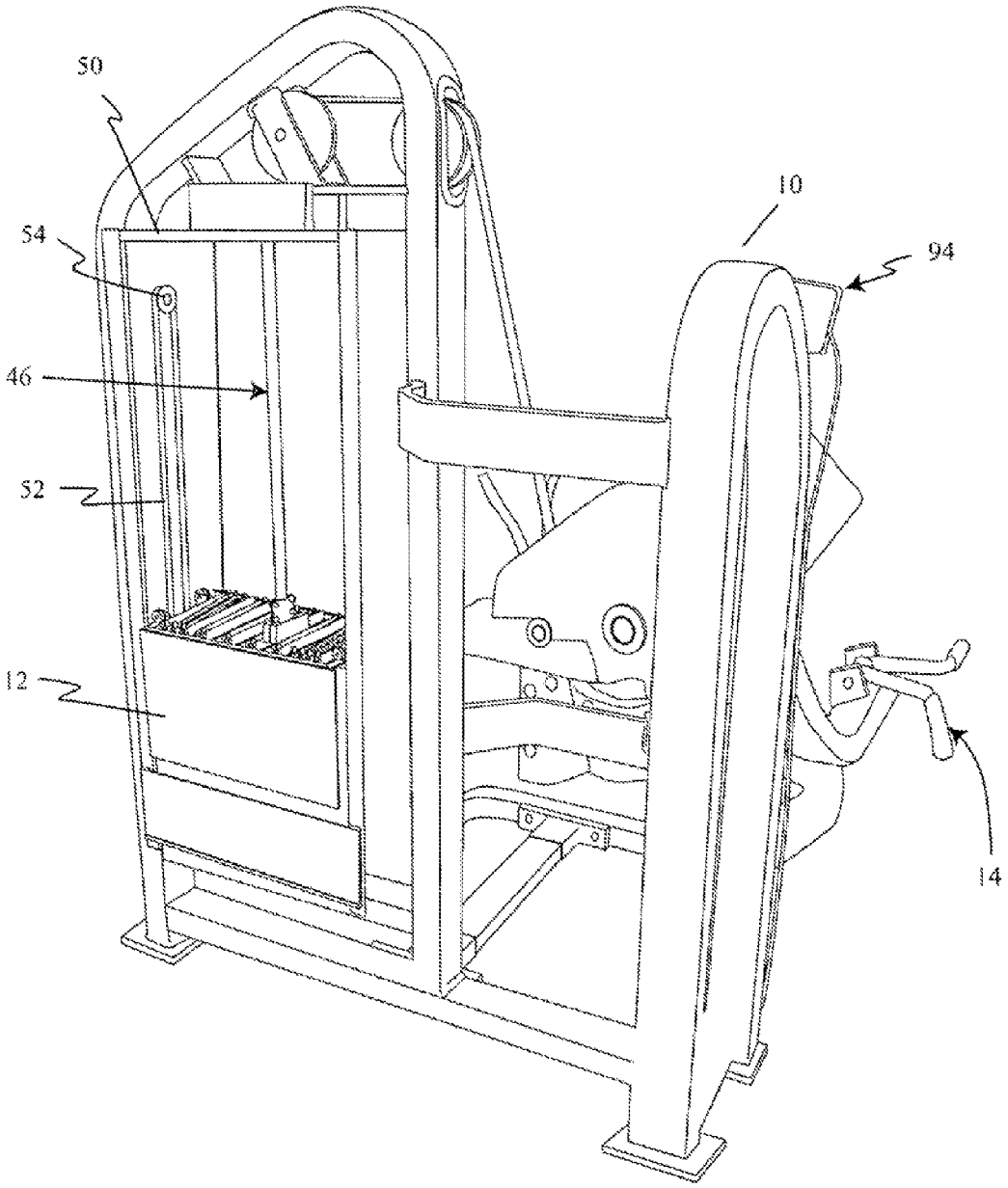
FIG. 1 is a back perspective view of an exercise machine having a variable resistance system constructed in accordance with the present invention.
Figure 2:
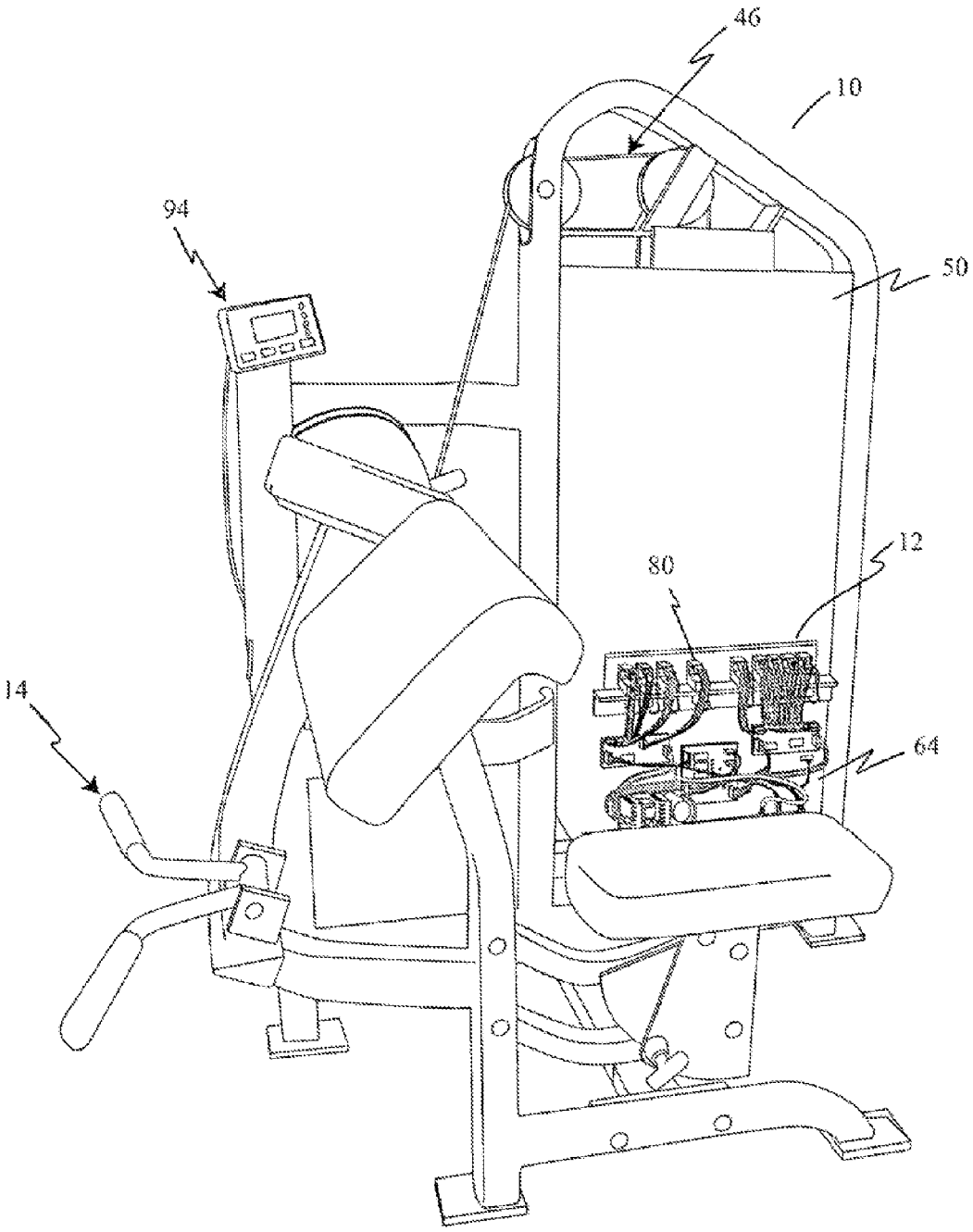
FIG. 2 is a front perspective view of the exercise machine of FIG. 1.

As illustrated in FIGS. 1 and 2, an exercise machine, generally designated 10, is provided with a variable resistance system 12. Variable resistance system 12 of the present invention is designed for use in connection with numerous types of exercise machines 10, both known and those that may yet be developed. For example, FIGS. 1 and 2 show a conventional exercise machine 10 for a bicep curl having a manually operable member 14 that a user grasps and moves against resistance. Although the variable resistance system 12 of the present invention is only shown as used with an exercise machine 10 for "bicep curl" exercises, variable resistance system 12 can be used to provide resistance for many types of exercise machines 10, which are utilized for many different types of exercises, including, for example, bench press, butterfly, cable cross over, lateral pull down, pull-up/dip assist, abdominal crunch, leg press, leg extension and squat type machines. These examples are provided for illustration purposes and are not intended to be limiting; variable resistance system 12 of the present invention can be used to provide resistance for virtually any type of exercise. Furthermore, variable resistance system 12 can be used to retrofit exercise machines 10 that originally used other sources of resistance, or can alternatively be built directly into new exercise machines 10.

Figure 3:
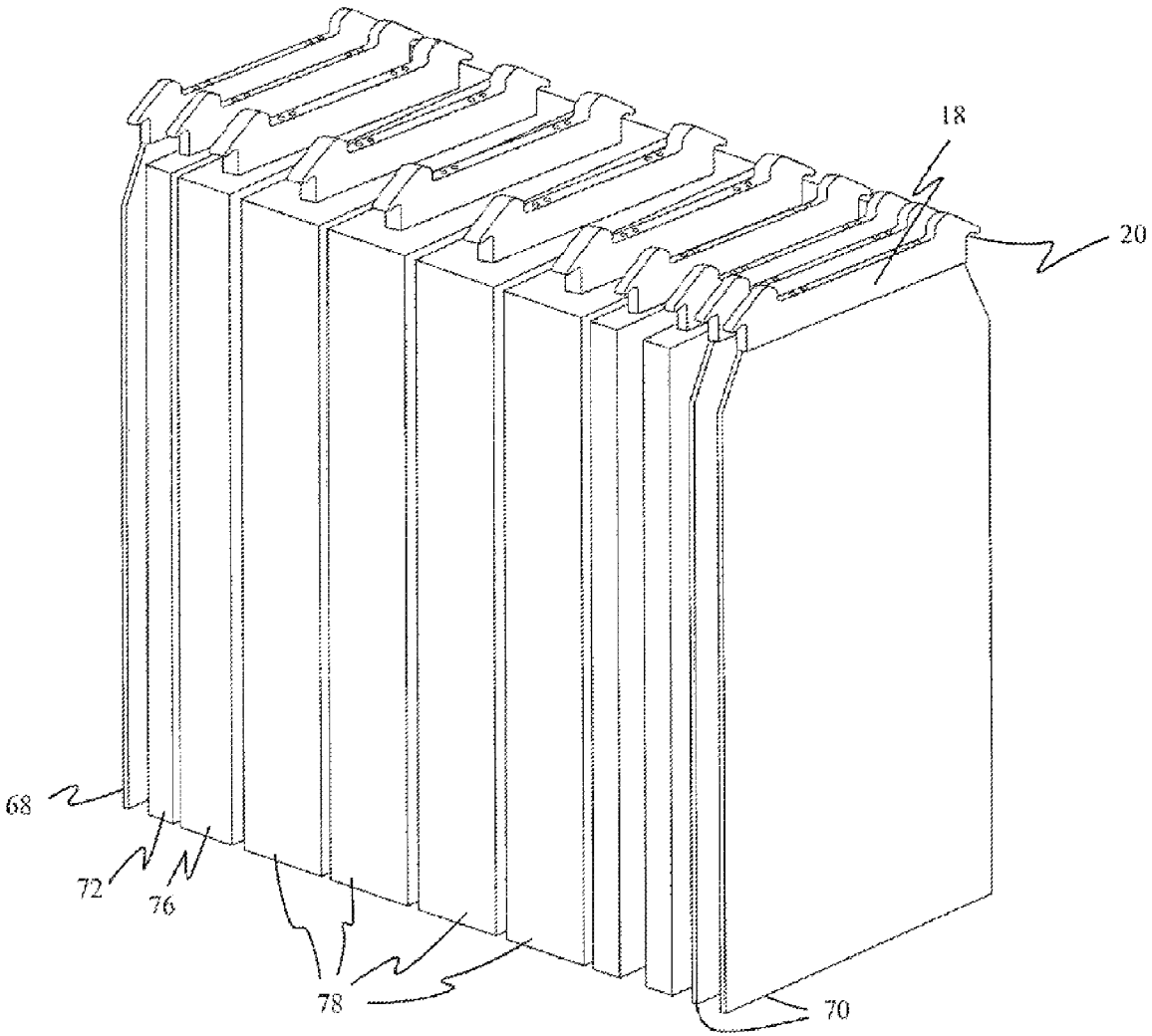
FIG. 3 is an upper perspective view of a weight stack for a variable resistance system constructed in accordance with the present invention.
Figure 4B:
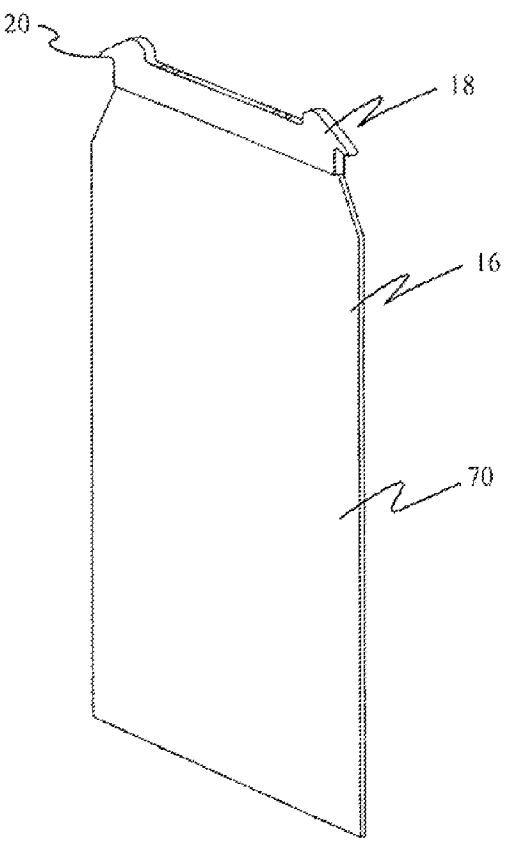
FIG. 4B is a perspective view of another type of weight from the weight stack of FIG. 3.
Figure 4A:
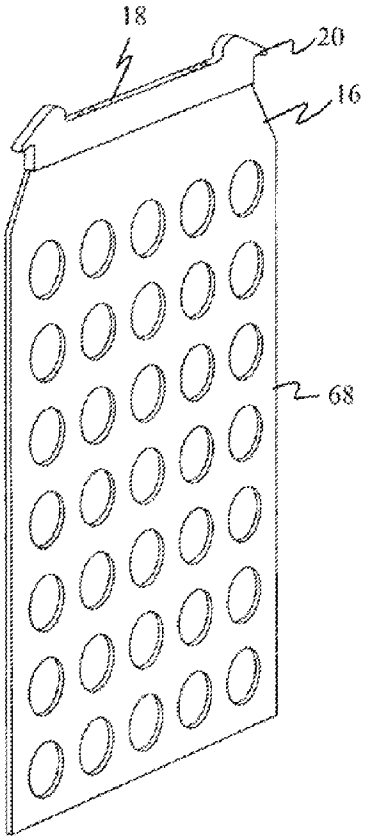
FIG. 4A is a perspective view of one type of weight from the weight stack of FIG. 3.
Figure 6:
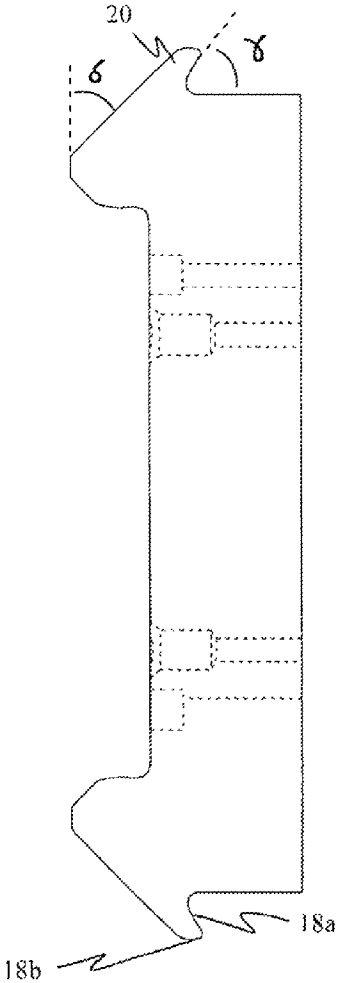
FIG. 6 is a side elevation view of the weight hook of FIG. 5.
Figure 5:
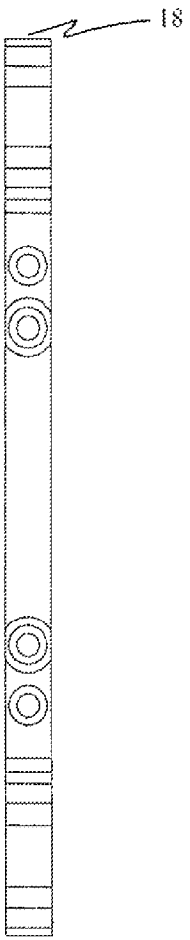
FIG. 5 is a top view of a weight hook of the variable resistance system of FIG. 1.

According to a preferred embodiment of the present invention, variable resistance system 12 includes a series of vertically oriented weight plates 16 (illustrated individually in FIGS. 4A and 4B), which are best shown in FIG. 3 as being disposed in variable resistance system 12 side-by-side, as if "stacked" horizontally relative to each other. However, the present invention is not limited to vertically oriented weights, and may be used with other forms of resistance providing members such as, by way of example, horizontally oriented weights, springs and elastic bands. Preferably, weight plates 16 have a weight hook 18 fixed to an upper portion of each weight plate 16. Weight hooks 18 may be fixed to weight plates 16 by various means such as, for example, screws. FIGS. 5 and 6 show a weight hook 18 detached from a weight plate 16 and in detail. Each weight hook 18 preferably has a downward facing hook portion 20 on each end.

Figure 7A:
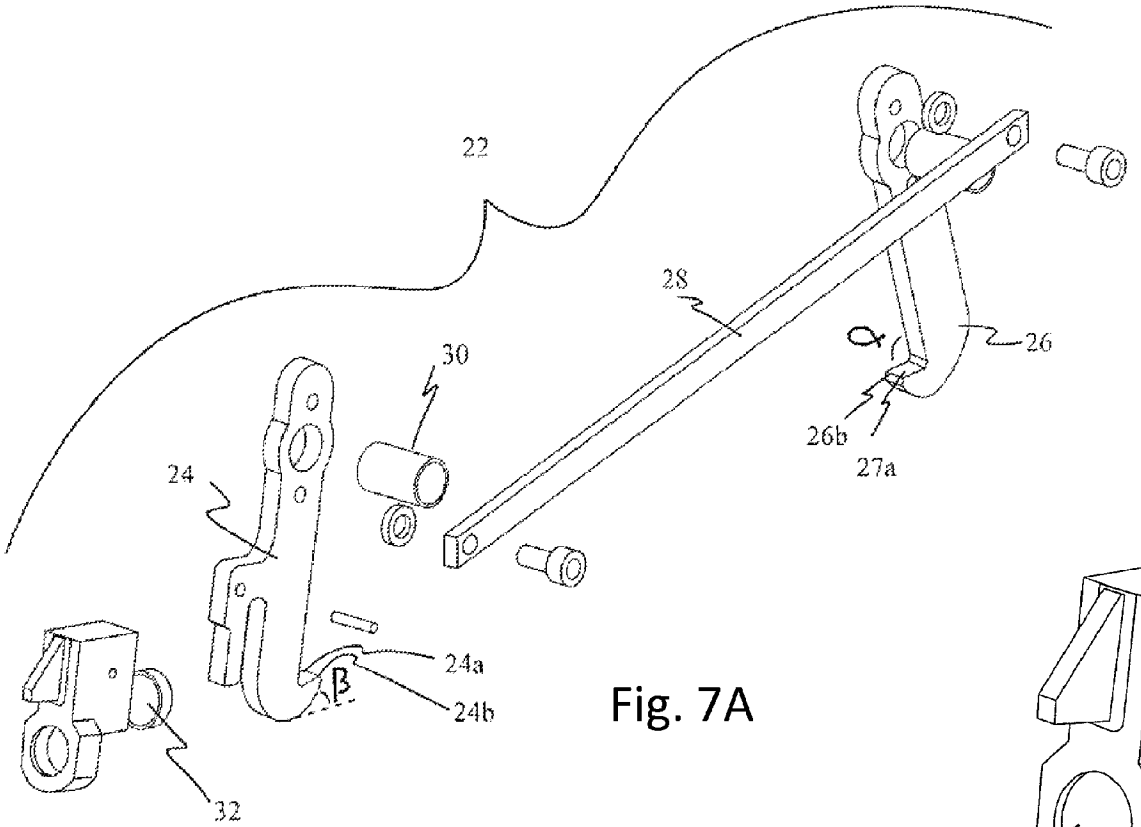
FIG. 7A is an exploded view of a weight selector hook assembly constructed in accordance with the system of FIG. 1, for engaging and lifting a weight of the system via a weight hook of the type illustrated in FIG. 5.
Figure 7B:
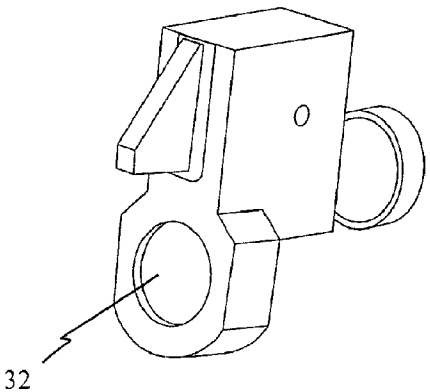
FIG. 7B is an enlarged view of the magnet portion of the weight selector hook assembly of FIG. 7A.

Weight hooks 18 are selectively engaged by selector hook assemblies 22; one such selector hook assembly 22 is illustrated in FIGS. 7A and 7B. Selector hook assembly 22 preferably comprises a first selector hook 24, a crossbar 28 and a second selector hook 26. Each selector hook 24, 26 preferably has a bearing 30 passing through it, where a bearing 30 is above the relevant connection with the crossbar 28 in the first selector hook 24 and below the connection with the crossbar 28 in the second selector hook 26. First selector hook 24 preferably has a selector magnet 32 fixed to its outer edge below the connection to crossbar 28.

Figure 8:
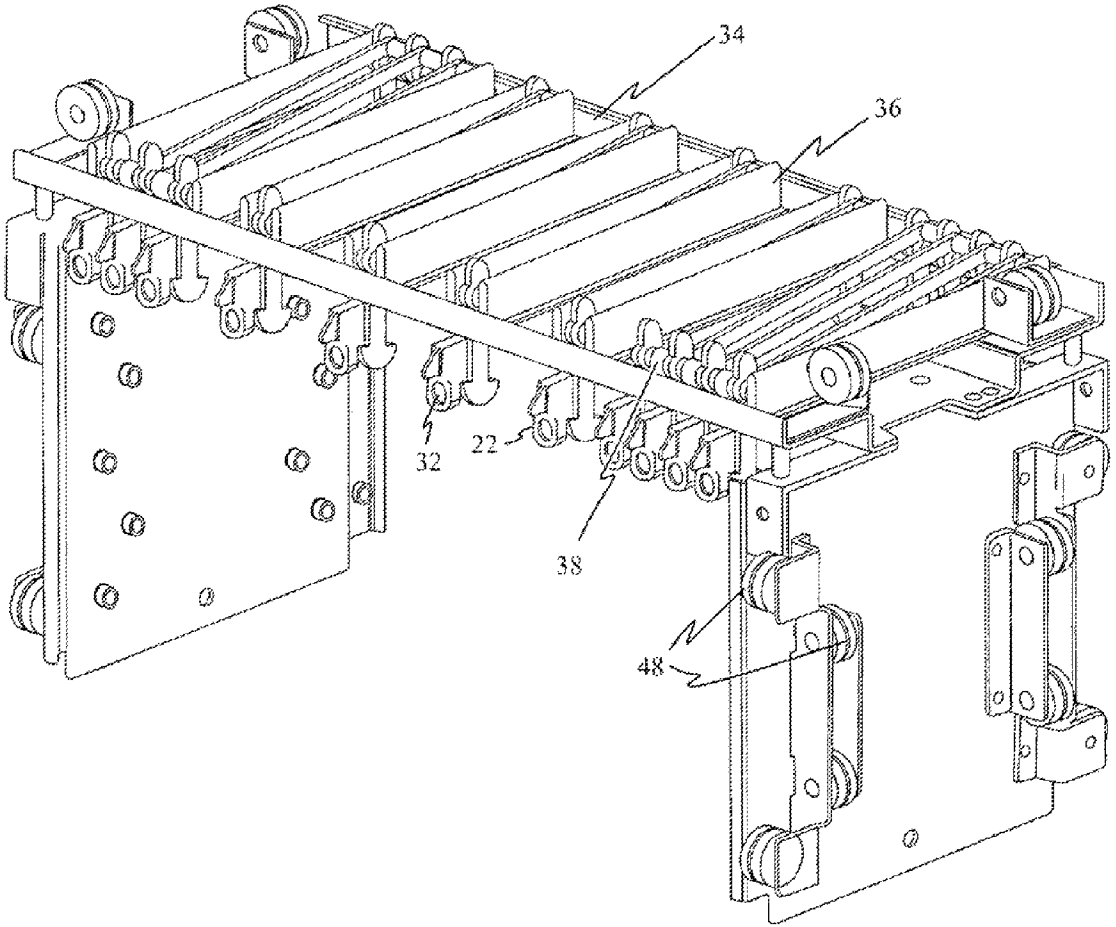
FIG. 8 is a perspective view of the weight selector assembly of the system of FIG. 1.
Figure 9:
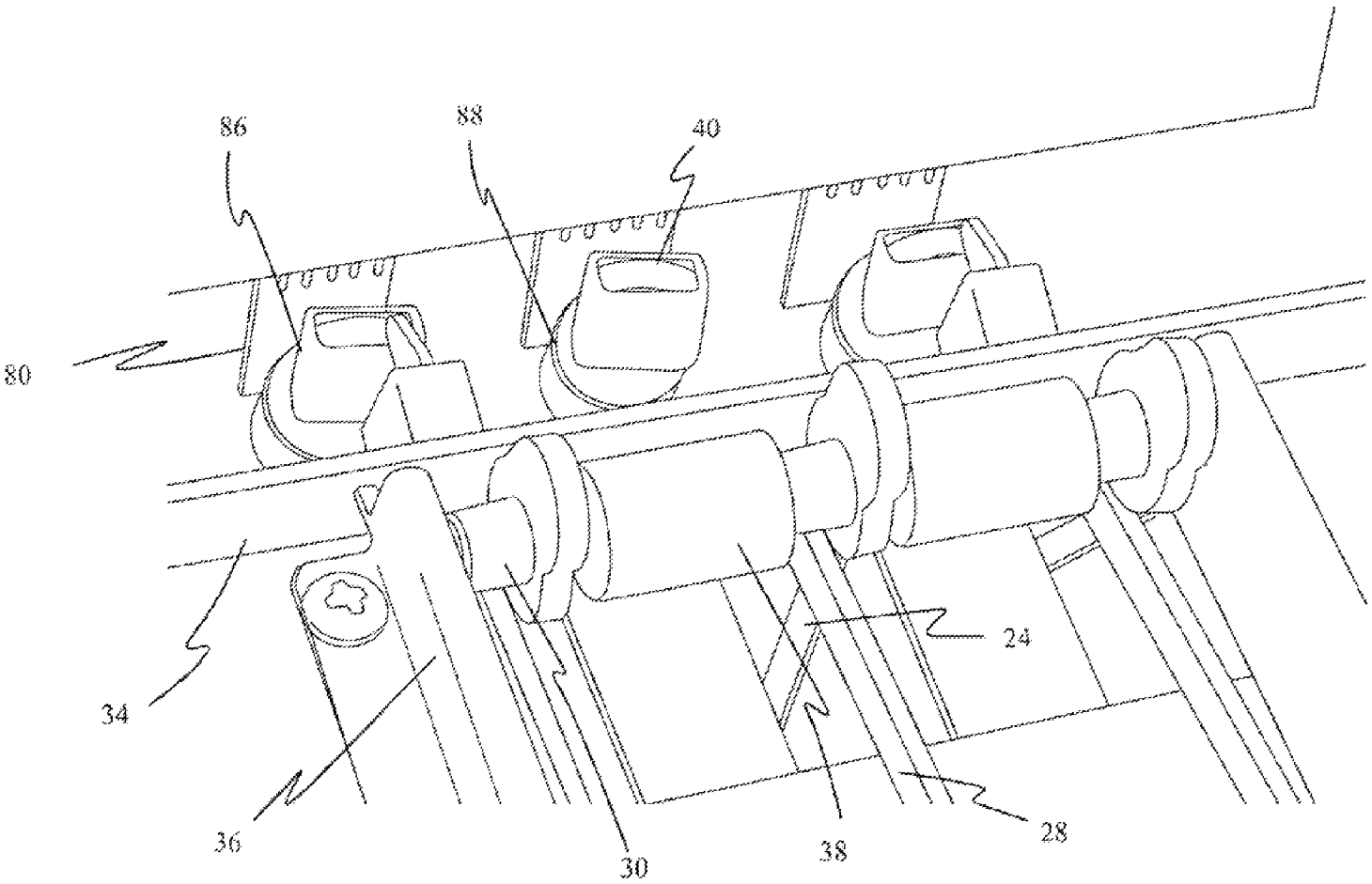
FIG. 9 is a partial, enlarged perspective view of a portion of the weight selector hook assembly of FIG. 8 in position within the housing of the system and showing a portion of the lift plate and actuators.
Figure 10:
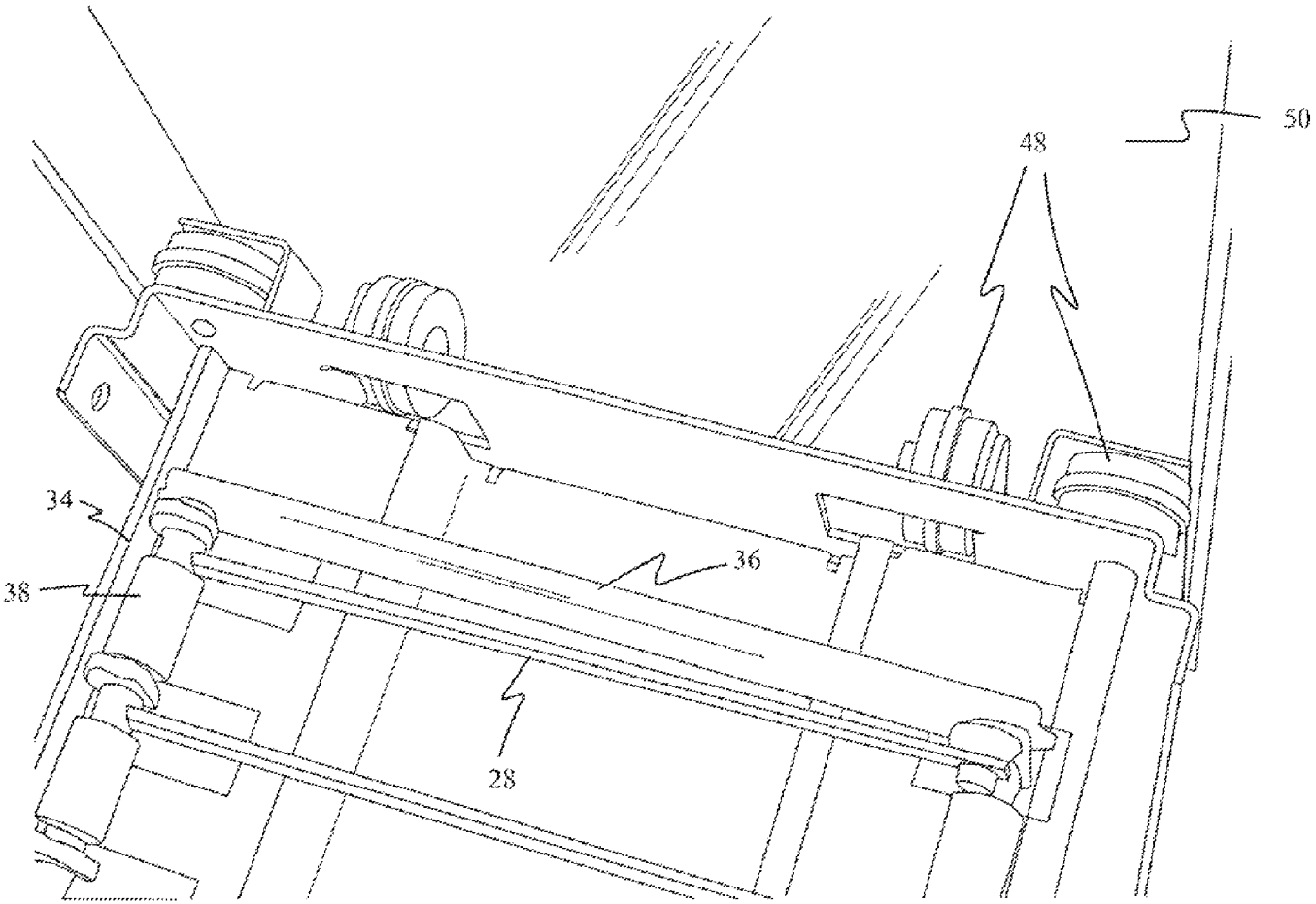
FIG. 10 is another partial, enlarged perspective view of the assembly of FIG. 8 at a different position within the housing of the system of FIG. 1.

Multiple selector hook assemblies 22 are preferably attached to a lift plate 34, as best shown in FIGS. 8-10. Pairs of brackets 36 are preferably mounted on the lift plate 34 and have two shafts fixed between them, which respectively pass through the bearings 30 on the first and second selector hooks 24, 26 of each selector hook assembly 22. According to the preferred embodiment, each pair of brackets 36 may support only one selector hook assembly 22, or may support multiple selector hook assemblies 22. If a single pair of brackets 36 supports multiple selector hook assemblies 22, spacers 38 may be necessary to properly position the respective selector hook assemblies 22, horizontally, relative to adjacent assemblies 22.

In operation of the preferred embodiment, one selector hook assembly 22 is provided for each weight plate 16, and the selector hook assemblies 22 selectively engage weight hooks 18. One actuator magnet 40 is preferably provided for each selector hook assembly 22, and each selector hook assembly 22 is preferably actuated by its respective actuator magnet 40. Actuator magnets 40 are preferably physically separate from lift plate 34 selector hook assemblies 22, and are discussed in greater detail below. The use of magnetic forces to actuate selector hook assembly 22 permits movement of selector hook assembly 22 to be dissociated from the position of an actuator assembly 80, which is discussed in detail below, which means that selector hook assembly 22 can freely move up and down without actuator assembly 80 moving with it, and without the need for physical components linking actuator assembly 80 with selector hook assembly 22.

Considering a single selector hook assembly 22 formed in accordance with the preferred embodiment, when an actuator magnet 40 does not exert an attractive force on its respective selector magnet 24, or alternatively when an actuator magnet 40 exerts a repulsive force on its respective selector magnet 24, the first and second selector hooks 24, 26 are drawn towards their respective weight hook 18 by gravity and/or the repulsive force of the actuator magnet 40, such that when selector hook assembly 22 is drawn upward by lift plate 34, selector hooks 24, 26 will engage their respective weight hook 18, pulling it upward as well, together with their respective weight plate 16.

Conversely, when actuator magnet 40 exerts an attractive force on selector magnet 32 the bottom portion of the first selector hook 24 is preferably drawn away from its respective weight hook 18. Considering the configuration and orientation of selector assembly 22 presented in FIGS. 7 and 7A, and considering that both selector hooks 24, 26 rotate about their respective bearing 30, when the bottom portion of first selector hook 24 is pulled away from the respective weight hook 18, which is towards the left in FIG. 7, the crossbar 28 is also pulled towards the left, which results in a counterclockwise rotation of the second selector hook 26 about its bearing 30, thereby drawing the bottom portion of the second selector hook 26 away from the respective weight hook 28 as well. Accordingly, in the embodiment shown, when actuator magnet 40 exerts an attractive force on selector magnet 32, both selector hooks 24, 26 are preferably drawn away from their respective weight hook 18, such that when selector hook assembly 22 is drawn upward, together with lift plate 34, selector hooks 24, 26 will not engage their respective weight hook 18, and the respective weight plate 16 will not be pulled upward (as a portion of the weight resistance) with lift plate 34. In this manner, the mechanism for selecting weight plates to be lifted in the preferred embodiment requires neither springs nor pins.

According to the preferred embodiment, when lift plate 34 is lowered and nears its lowest position (the "home" position discussed below), the outer surface of each selector hook 24, 26 will tend to slide over the outer surface of each weight hook 18 because both surfaces are provided at an angle tending to press the selector hooks 24, 26 outward. However, once the tip of the selector hook 24*b*, 26*b* passes below the tip of the weight hook 18*b*, the selector hooks 24, 26 will fall back inward, unless acted on by an attractive force between selector magnet 32 and actuator magnet 40 so as to prevent engagement of weight hook 18 by selector hooks 24, 26, as discussed above. Once selector hooks 24, 26 have fallen back inward, when lift plate 34 is raised the inner surface of selector hooks 24, 26 will engage inner surface of weight hooks.

Thus, the inner angle $\alpha$ of selector hooks 24, 26 (shown in FIG. 7A) and the inner angle $\gamma$ of weight hooks 18 (shown in FIG. 6) are preferably selected such that the engagement of selector hooks 24, 26 and weight hooks 18 is secured by the weight of weight plate 16. That is to say, when selector hooks 24, 26 are engaged with weight hooks 18, the inner angles $\alpha$, $\gamma$ are small enough that the weight of weight plate 16 causes an inner surface of selector hooks 24*a*, 26*a* at angle $\alpha$ to interact with an inner surface of weight hooks 18*a* at angle $\gamma$, such that selector hooks 24, 26 have a tendency to rotate towards weight hooks 18, thereby securing the engagement while weight plate 16 is being lifted. The inner angles $\alpha$ and $\gamma$ must also be large enough such that, when actuated to do so, selector hooks 24, 26 will disengage from weight hooks 18; that is to say the outer tip of selector hooks 24*b*, 26*b* must clear the outer tip of weight hooks 18*b* when the lift plate is in home position and selector hooks 24, 26 are rotated away from weight hooks 18. The outer angle $\beta$ of selector hooks 24, 26 (shown in FIG. 7A) and the outer angle $\delta$ of weight hooks 18 (shown in FIG. 6) are preferably selected such that selector hooks 24, 26 traveling downward towards a stationary weight hook 18 are forced open to allow selector hooks 24, 26 to slide over weight hooks 18. According to the preferred embodiment, $\alpha$ is approximately 72°, $\beta$ is approximately 55°, $\gamma$ is approximately 60°, and $\delta$ is approximately 45°.

Lift plate 34 is preferably pulled upward by a cable 46 or other lifting member, such as a belt, that is ultimately driven by manually operable member(s) 14 being moved by a user. According to the preferred embodiment, and as best shown in FIG. 10, lift plate 34 is guided by a set of guide wheels 48 on two opposing sides of the lift plate 34. Guide wheels 48 preferably act against a housing 50 so that lift plate 34 is substantially restrained from shifting in the horizontal plane during movement and thus facilitates extremely quiet operation of system 12.

In the depicted embodiment, when the lift plate 34 is in its lowest position the selector hooks 24, 26 are able to engage or disengage their respective weight hooks 18. Lift plate 34 is preferably able to travel a small distance above its lowest position and still allow selector hooks 24, 26 to engage or disengage their respective weight hooks 18. This vertical distance is very limited to prevent injury to the user and damage to variable resistance system 12; in a preferred embodiment, this vertical distance is approximately 0.125 inches. The limited vertical range of lift plate 34 in which selector hooks 24, 26 are able to engage or disengage their respective weight hooks 18, including the lowest position of lift plate 34, is considered the "home" position of the lift plate 34.

Figure 11:
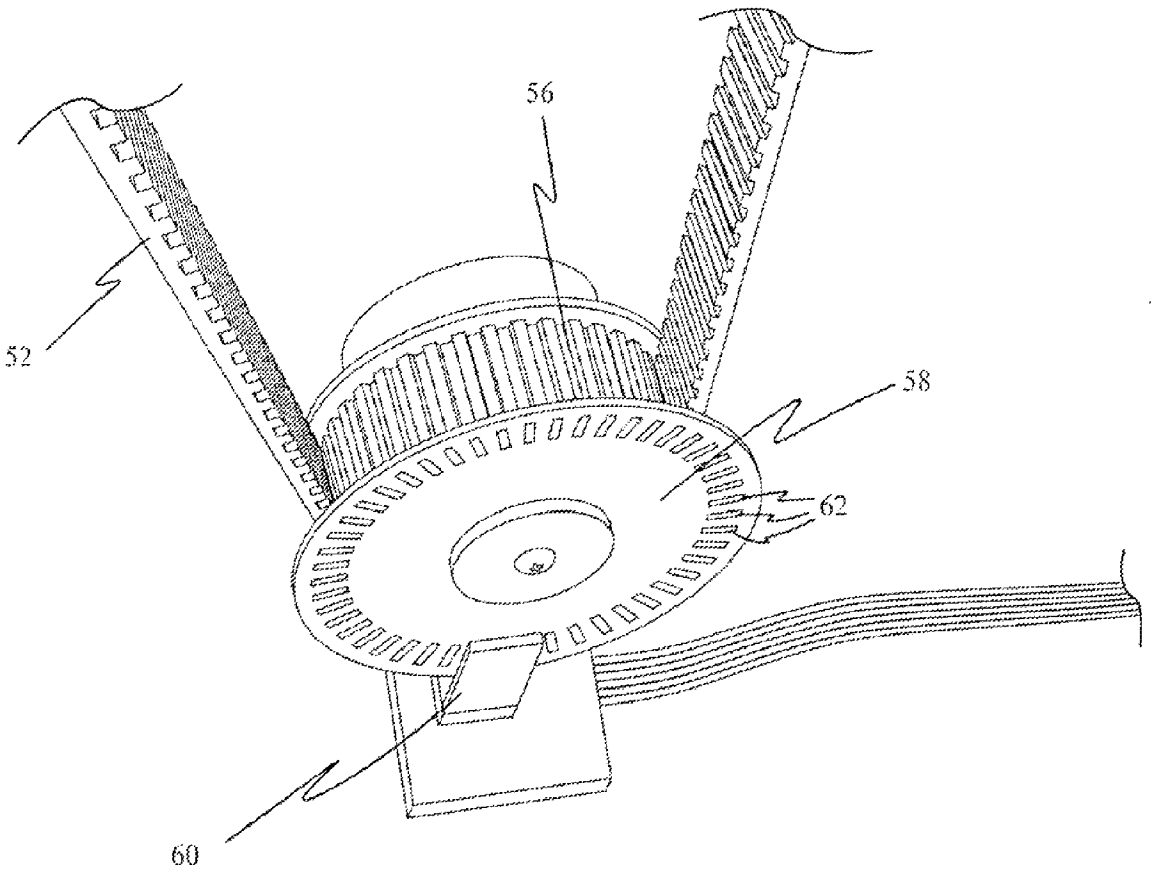
FIG. 11 is an enlarged perspective view of the optical sensor and slotted disk assembly of the system of FIG. 1.

A sensor is preferably incorporated into the variable resistance system 12 that facilitates monitoring of the vertical movement of the lift plate 34. According to the preferred embodiment, lift plate 34 is connected to a timing belt 52, which can be seen within the system housing in FIG. 1. Timing belt 52 is preferably connected to and between two pulleys 54, 56, an upper pulley 54 near the top of the potential of vertical travel of lift plate 34, and a lower pulley 56 near the bottom of the potential vertical travel of lift plate 34. In the preferred embodiment, one of pulleys 54, 56 is connected to a slotted disk 58 that works in conjunction with an optical sensor 60, in known manner, to determine the vertical movement of the lift plate 34, as shown in FIG. 11. Slotted disk 58 preferably has seventy-two slots 62 disposed at five degree increments near its circumference. Optical sensor 60 preferably senses each time a slot 62 passes, and sends a signal corresponding to each passing slot to controller 64, which is discussed in greater detail below. In this manner, the rotation of pulley 54, 56 to which slotted disk 58 is attached can be sensed, and thus the vertical movement of lift plate 34 can be derived.

Figure 12:
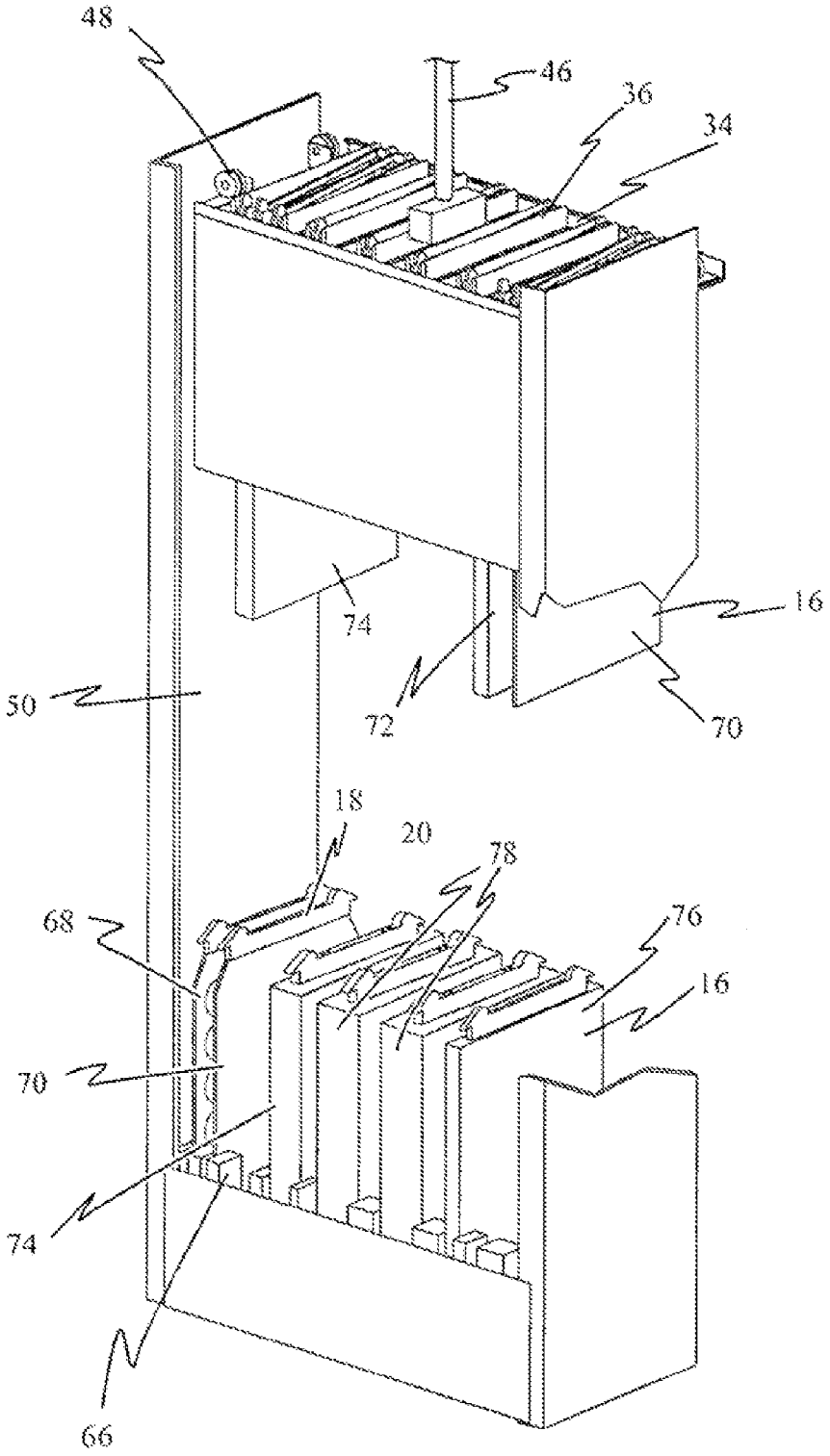
FIG. 12 is a rear perspective view of the machine of FIG. 1 with the rear plate of the housing removed to illustrate the weight stack with some weights selected and in the raised position.

As best seen in FIG. 12, weight plates 16 that are not engaged by the selector hook assemblies 22 and, therefore, not pulled upward with the lift plate 34, are preferably seated in positioning grooves 66 in the base of the variable resistance system 12 so that such weight plates 16 remain appropriately positioned during movement of the lift plate 34. Preferably, the uppermost portion of these positioning grooves 66 are tapered such that relatively minor shifts in the weight plates 16 that may occur while being lifted are automatically corrected when the weight plates 16 are returned to a resting position.

According to the embodiment illustrated in FIG. 12, the series of weight plates 16 is selected to allow one pound increments of weight resistance increase or decrease. This embodiment incorporates one one-pound-plate 68, two two-pound-plates 70, one five-pound-plate 72, two ten-pound-plates 74, one twenty-seven-pound-plate 76, and two fifty-four-pound-plates 78. It should be appreciated that numerous combinations of weight plates 16 may be used to provide desired minimum increments and maximum weight. Of course, other combinations of weights for the multiple weight plates in the system may be utilized successfully.

Thus, according to the preferred embodiment, by selectively applying an attractive force between actuator magnets 40 and selector magnets 32, variable resistance system 12 can selectively cause desired weight plates 16 to be pulled upward with lift plate 34, while leaving the other weight plates 16 in place.

Figure 13B:
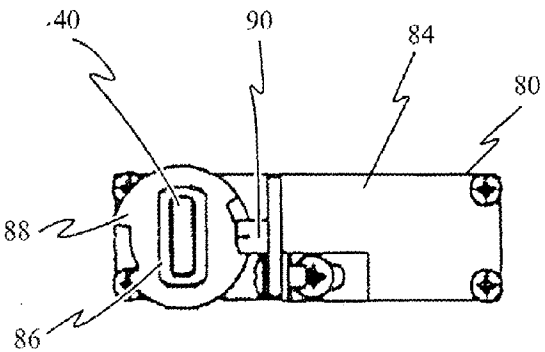
FIG. 13B is plan view of the hook actuator assembly of FIG. 13A in assembled position.
Figure 13C:
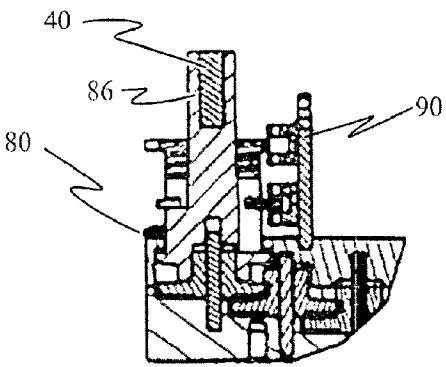
FIG. 13C is a sectional view of the hook actuator assembly of FIG. 13B.
Figure 13A:
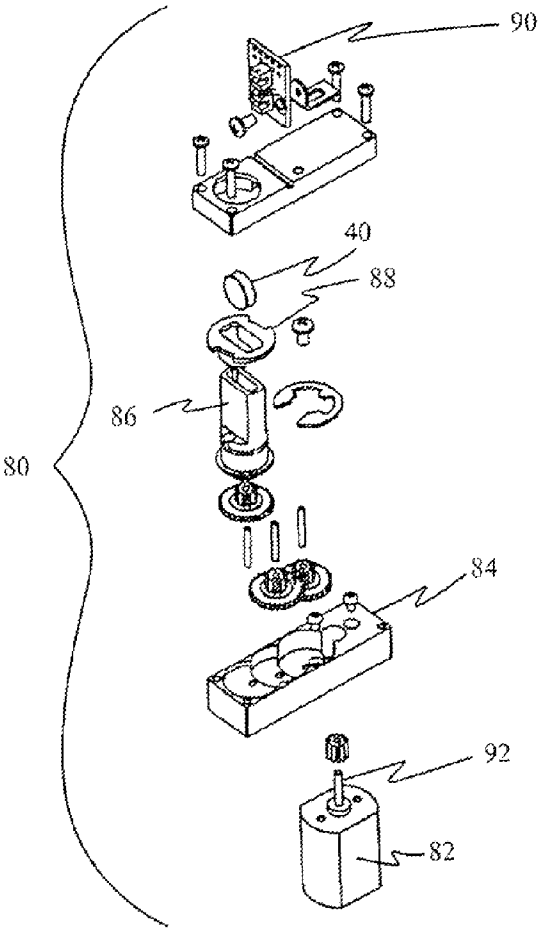
FIG. 13A is an exploded schematic view of the hook actuator assembly of the system of FIG. 1.

According to the preferred embodiment, actuator magnets 40 have two poles. When a first pole faces selector magnet 32 a repulsive force acts on selector magnet 32, and when a second pole faces selector magnet 32 an attractive force acts on selector magnet 32. The actuator magnets 40 are preferably controlled by actuator assemblies 80, as illustrated in FIGS. 13A, 13B and 13C. Actuator assemblies 80 preferably include a motor 82, a gear box 84, a magnet sleeve 86 containing actuator magnet 40, an orientation disk 88 and an optical sensor 90. Motor 82 is preferably controlled by a controller 64, which is discussed in detail below. In operation of the preferred embodiment, when actuation of the actuator magnet 40 is desired, controller 64 causes a current to pass through the armature of motor 82, causing shaft 92 of motor 82 to rotate. Gear box 84 preferably reduces the rotation speed of motor shaft 92 and transmits the rotation to magnet sleeve 86 containing actuator magnet 40.

Actuator magnet 40 is preferably rotated between an attractive orientation, in which actuator magnet 40 exerts an attractive force on selector magnet 32, and a repulsive orientation, in which actuator magnet 40 exerts a repulsive force on selector magnet 32. To switch between the attractive orientation and the repulsive orientation, actuator magnet 40 is rotated approximately one hundred and eighty degrees. Orientation disk 88 rotates with magnet sleeve 86 and has two slots. One slot is aligned with the attractive orientation, and the other slot is aligned with the repulsive orientation. In the preferred embodiment, optical sensor 90 senses the slots of the orientation disk 88 and provides a signal to the controller 64 corresponding to the presence or absence of a slot. In this manner controller 64 is able to more precisely control the orientation of actuator magnet 40, based on the signal provided by optical sensor 90. That is to say optical sensor 90 and the orientation disk 88 help controller 64 to more precisely rotate the actuator magnet 40 in order to switch from a repulsive orientation to an attractive orientation and vice versa.

Figure 14:
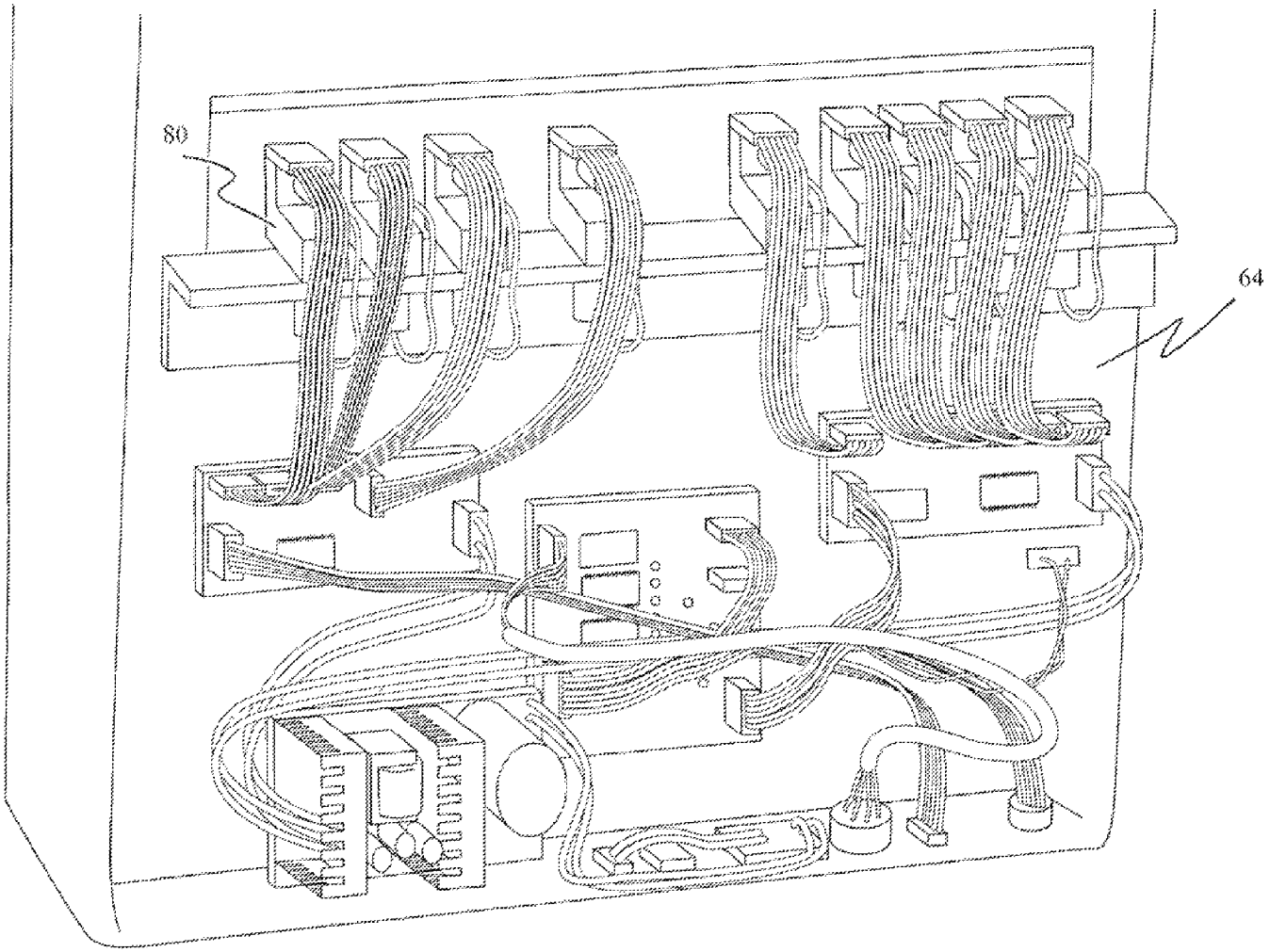
FIG. 14 is a front perspective view of the electronic control panel of the system of FIG. 1, with the protective panel removed.

Controller 64 and actuator assemblies 80 of the preferred embodiment are illustrated in FIG. 14; however, in a commercial embodiment of the present invention, this portion of the apparatus would be covered from view and access by the consumer or user (for example by a solid metal plate), for safety. Controller 64 preferably receives input signals from both the optical sensors 90 on actuator assemblies 80 and optical sensor 60 on upper or lower pulley 54, 56, and transmits this data to a user interface console 94, which is discussed in greater detail below. Controller 64 also preferably receives command instructions from user interface console 94 and aligns the individual actuator magnets 40 to repulsive or attractive orientations according to such command instructions.

Figure 15:
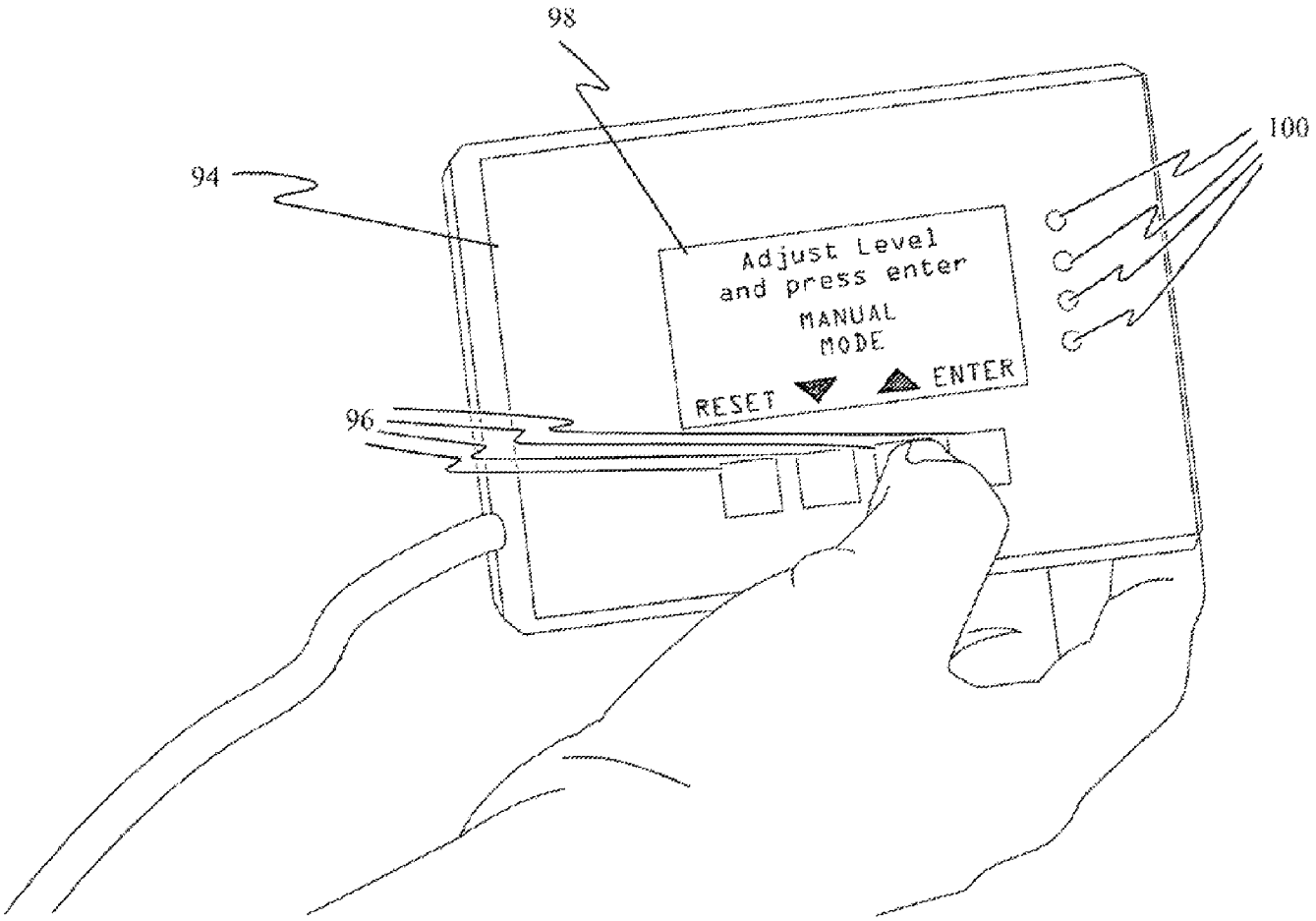
FIG. 15 is a perspective view of the user interface console of the system of FIG. 1.
Figure 16:
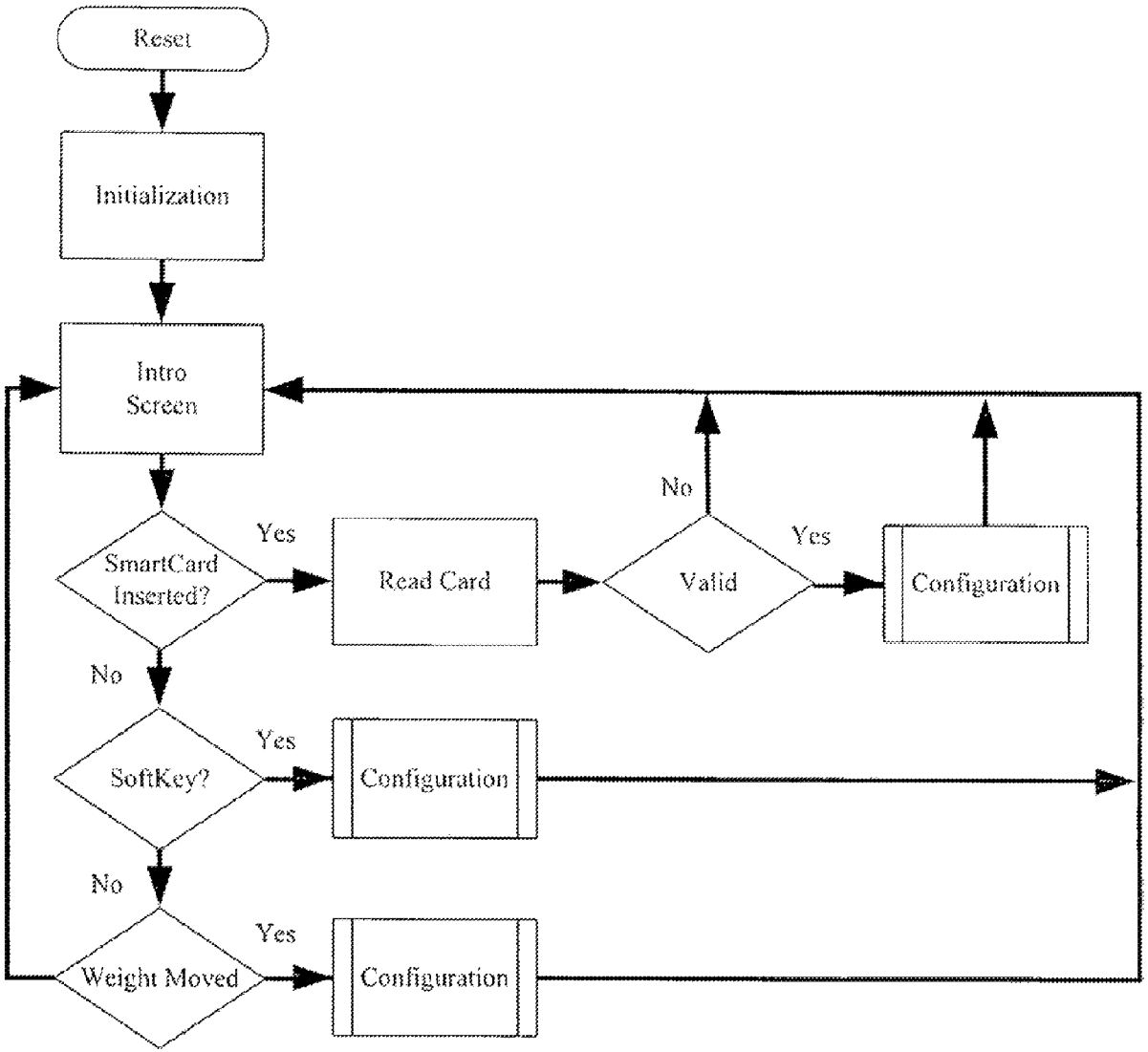
FIG. 16 is a flowchart illustrating logic at the introduction screen of a user interface console.
Figure 17:
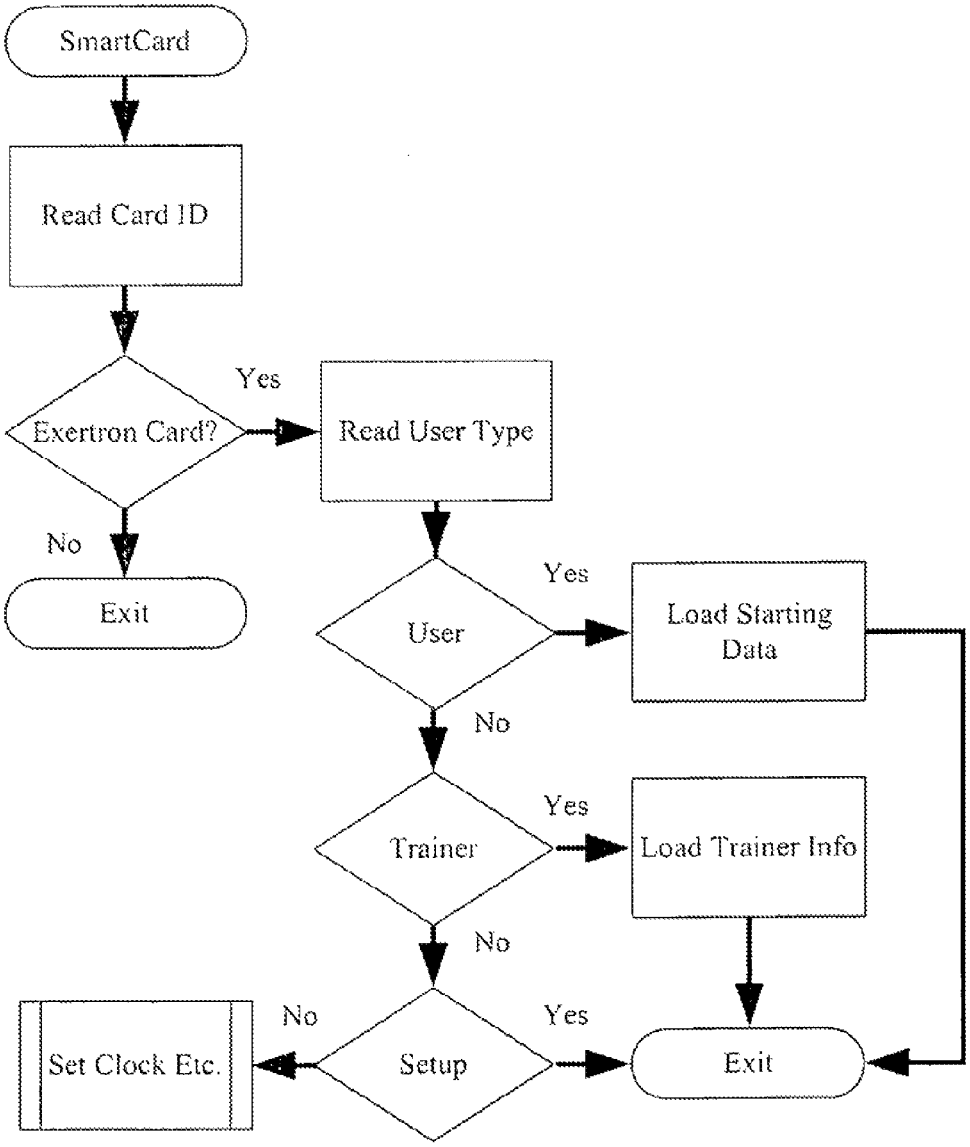
FIG. 17 is a flowchart illustrating logic used by a user interface console when reading a memory card.
Figure 18:
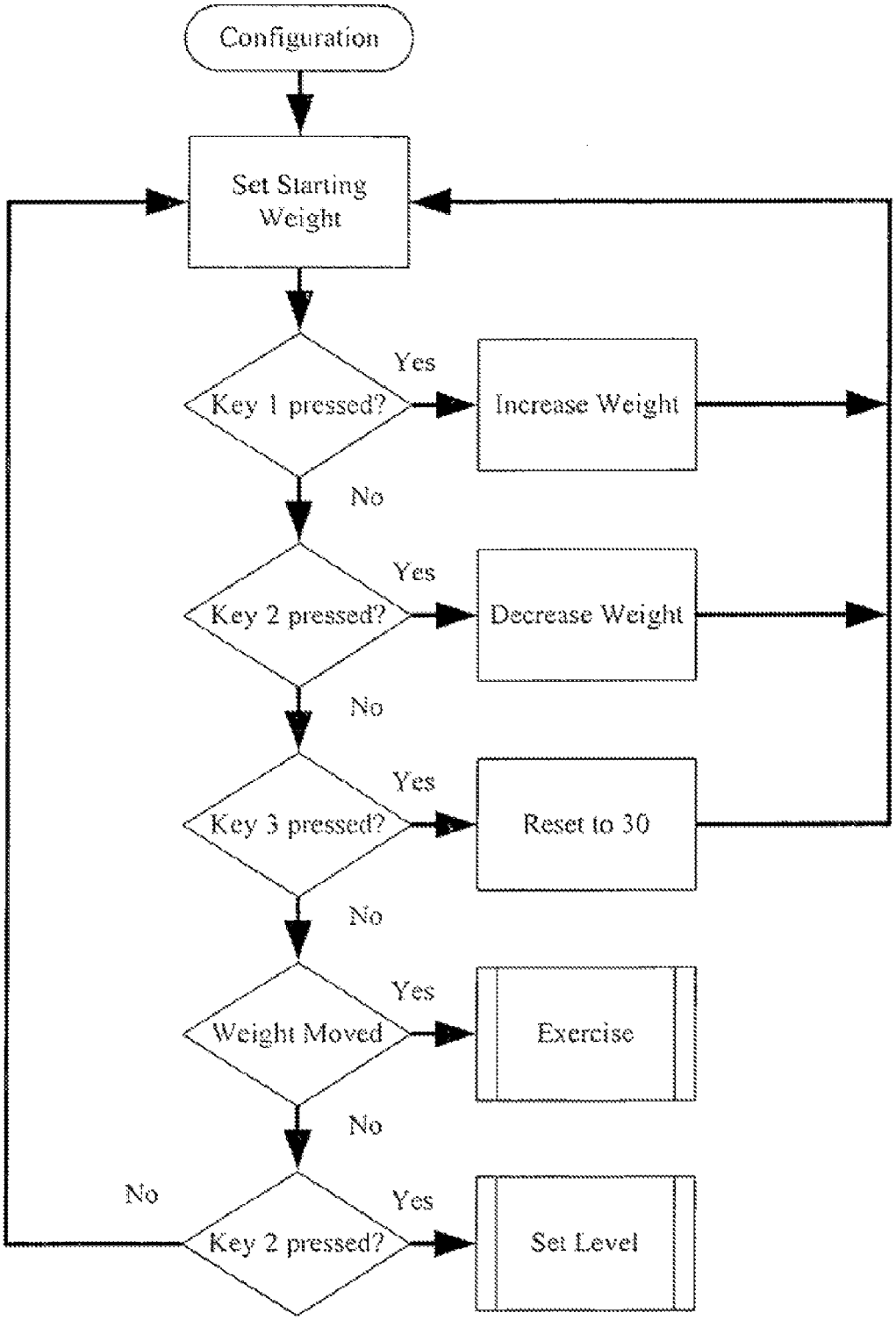
FIG. 18 is a flowchart illustrating logic used by a user interface console when configuring exercise parameters, particularly starting weight.
Figure 19:
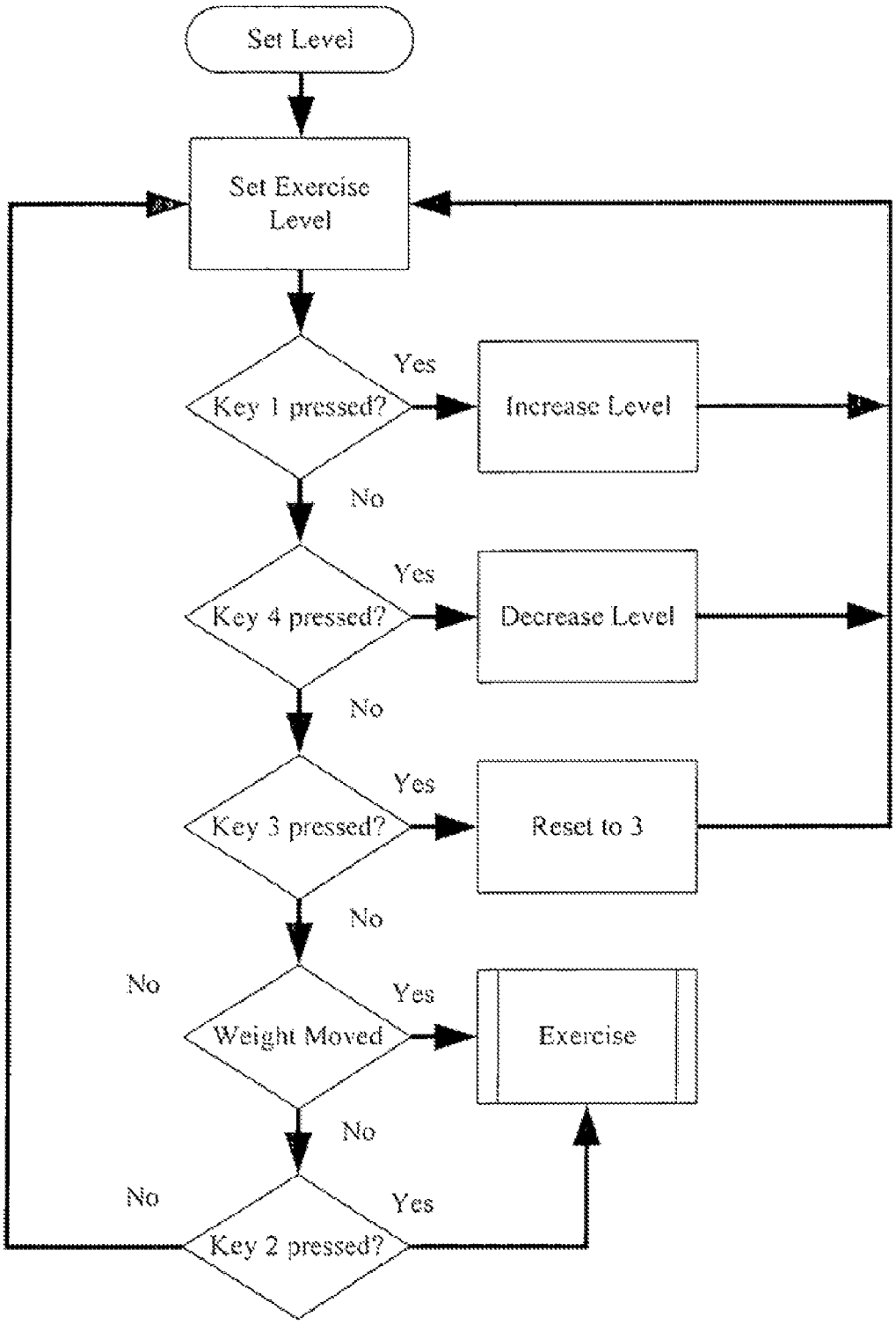
FIG. 19 is a flowchart illustrating logic used by a user interface console when configuring exercise parameters, particularly intensity level.
Figure 20:
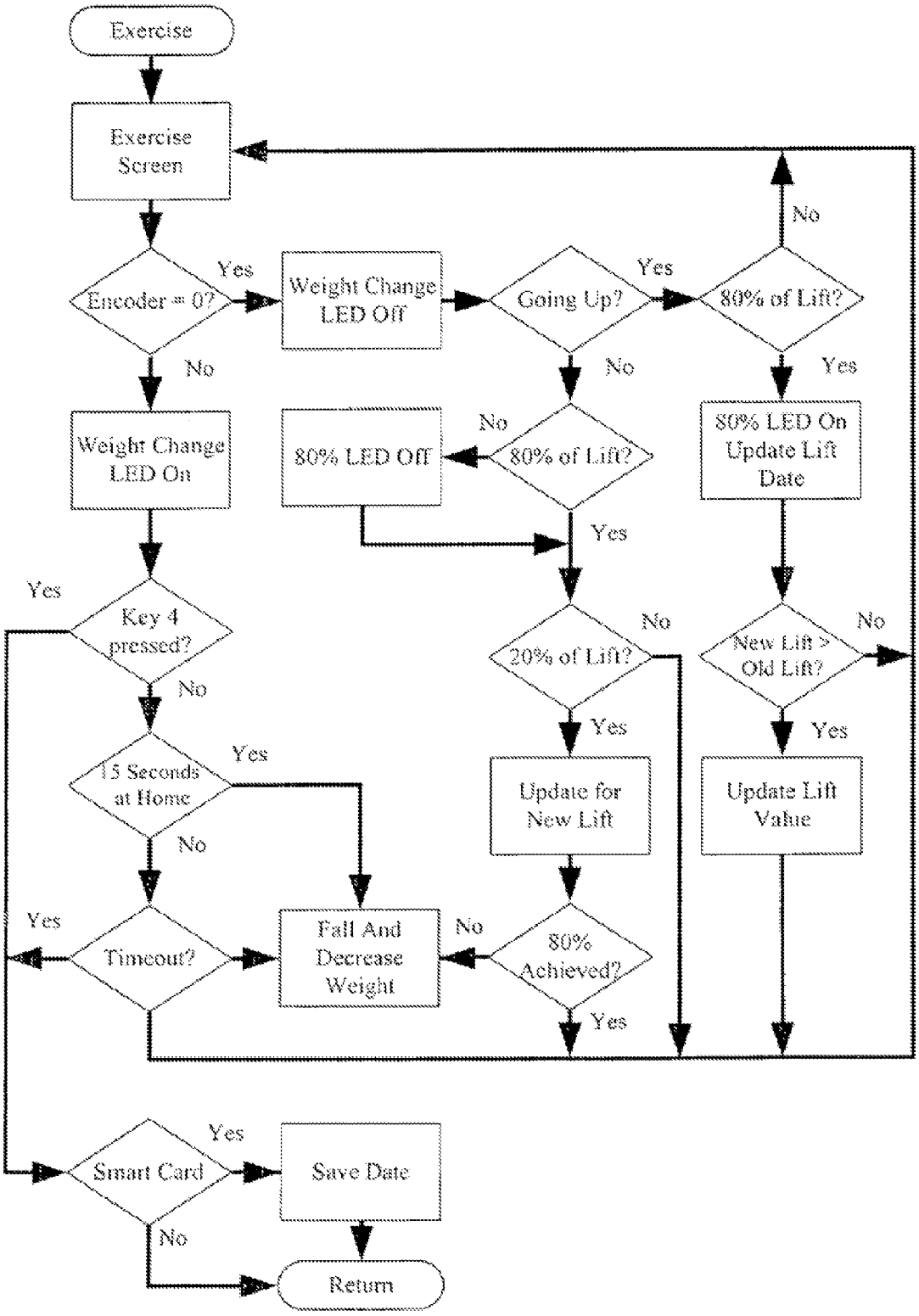
FIG. 20 is a flowchart illustrating logic used by a user interface console during exercise under an automatic weight change setting.
Figure 21:
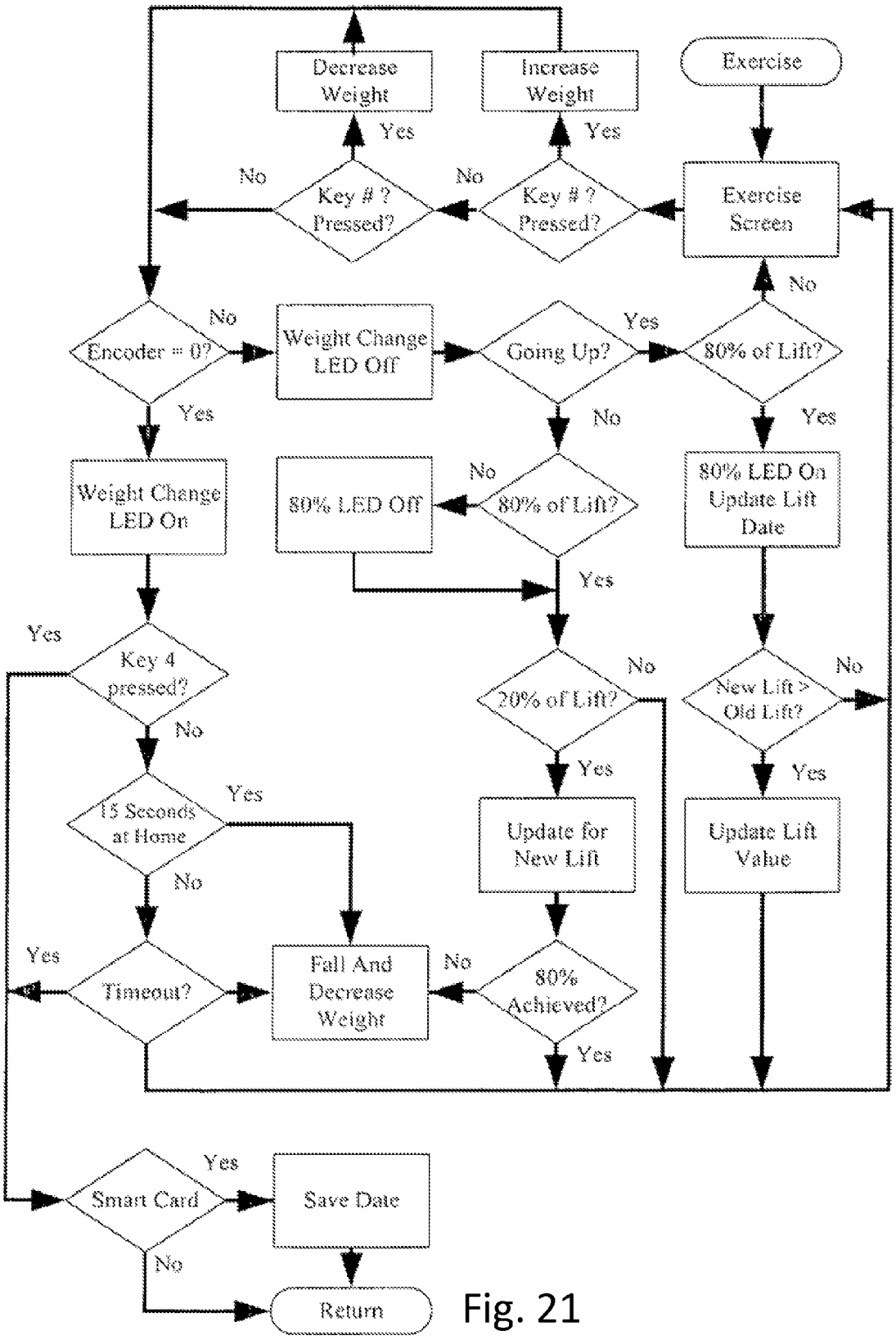
FIG. 21 is a flowchart illustrating logic used by a user interface console during exercise under a manual weight change setting.

User interface console 94 of the preferred embodiment is illustrated in FIG. 15 and preferably has four buttons 96, an LCD display 98 and four LED's 100, although other arrangements on the console can be imagined that will suffice. User interface console 94 is preferably attached to exercise machine 10 at a location providing convenient access to a user without requiring the user to move from use position in order to see and readily access the console.

According to the preferred embodiment, prior to exercising a user inputs various values into the user interface to customize his or her exercise. A given variable resistance system 12 may incorporate any number of different types of inputs.

Variable resistance system 12 of the preferred embodiment has two user inputs: intensity level and starting weight. According to this embodiment, the user selects a starting weight and an intensity level ranging from one to ten, or alternatively the user may select manual. Once the user enters a starting weight, the variable resistance system selects among weight plates 16 such that the total resistance is equal to the selected starting weight. If no starting weight is entered, a default starting weight is preferably automatically selected.

According to the preferred embodiment, variable resistance system 12 selects a given weight by user interface console 94 communicating to the controller 64 which weight plates 16 are to be selected, and controller 64 causes actuating magnets 40 to rotate into the orientation appropriate to cause selector hooks 24, 26 to engage weight hooks 18 for each weight plate 16 that is to be lifted. Conversely, controller 64 causes actuating magnets 40 to rotate into the orientation that causes selector hooks 24, 26 to not engage weight hooks 18 for each weight plate 16 that is not to be lifted.

According to the preferred embodiment, when the user begins exercising, controller 64 monitors the vertical travel of lift plate 34, as described above. On the first repetition, the maximum vertical travel of lift plate 34 is preferably recorded as the user's maximum range. If lift plate 34 is lifted higher on a subsequent repetition, the user's maximum range is preferably reset to the new, higher value. In the preferred embodiment, each repetition in which lift plate 34 is lifted to or above a given percentage of the maximum range is considered a successful repetition. The percentage of the maximum range necessary to constitute a successful repetition can be set at any reasonable value; however, the percentage is preferably in the range of eighty to ninety-five percent.

According to the preferred embodiment, when a successful repetition is achieved, the uppermost LED 100 on user interface console 94 automatically turns on and user interface console 94 preferably makes an audible beep. The illuminated uppermost LED 100 and the audible beep indicate to a user that he or she has achieved a successful repetition. Clearly, the system will operate successfully without the presence of the audible beep, and even without any visual indication that the presence or absence of an audible beep or other indicator of a successful repetition, as the automatic adjustment in resistance level will be altered regardless of any indicator of the required criteria.

After each successful repetition, the total weight (resistance) lifted is incrementally increased, preferably at any preselected reasonable value. In the preferred embodiment the incremental increase in weight is approximately five percent. That is to say, after each successful repetition, a new weight is calculated that is approximately five percent greater than the weight lifted in the last successful repetition. The weight that is actually lifted can be rounded down to the nearest available value.

According to the preferred embodiment, on a given repetition when a user does not raise lift plate 34 to the percentage of the maximum range necessary to constitute a successful repetition, such repetition is considered a "failed" repetition. After a failed repetition, the weight lifted is incrementally decreased, as determined on the basis of the intensity level pre-selected by the user. The incremental decrease and increase in weight utilized in the preferred embodiment are set forth in Table 1 below.

TABLE 1

Incremental Decrease & Increase of Resistance

| Intensity Level | Weight Decrement (%) | Weight Increment (%) |
|---|---|---|
| Manual | 0 | 0 |
| 1 | 60 | 5 |
| 2 | 55 | 5 |
| 3 | 50 | 5 |
| 4 | 45 | 5 |
| 5 | 40 | 5 |
| 6 | 35 | 5 |
| 7 | 30 | 5 |
| 8 | 25 | 5 |
| 9 | 20 | 5 |
| 10 | 15 | 5 |

As shown in Table 1, if a user selects manual mode, the weight lifted with the lift plate is neither automatically increased nor decreased, regardless of the status of the repetition. If manual mode is chosen, a user must manually select a different weight value on the user interface console 94 if he or she desires a different amount of weight.

According to the preferred embodiment, variable resistance system 12 is able to determine whether a repetition is a success or a failure once the vertical travel of lift plate 34 reaches a peak, that is to say when the vertical travel of the lift plate changes from upward to downward. At this point variable resistance system 12 is preferably able to calculate the amount of weight to be lifted on the next repetition almost instantaneously. Thus, at the point in time directly after the vertical travel of lift plate 34 has peaked, user interface console 94 preferably communicates which weight plates 16 are to be lifted and which weight plates 16 are not to be lifted to controller 64, and controller 64 causes the appropriate actuating magnets to rotate 40 accordingly. Thus, all actuating magnets 40 are preferably each properly oriented for the next repetition well before lift plate 34 returns to a home position. In this manner as soon as lift plate 34 is in the home position, the appropriate selector hooks will engage or disengage their respective weight hooks 18.

According to the preferred embodiment an optional memory card 102 is available for users to store information related to prior exercise. User interface console 94 preferably has an interface in which a user may insert memory card 102. According to this embodiment, memory card 102 automatically provides all applicable user input values to the user interface, so that the user only needs to insert his or her card, and does not need to remember or manually input any values, unless he or she wishes to deviate from the information stored on memory card 102. Such memory cards 102 can also be designed so that they are capable of interfacing with a personal computer, on which information related to a user's exercise history and/or routine may be viewed and/or manipulated. In this manner the exercise history of a user can be tracked and/or compared with various indicia of personal fitness such as, for example, the user's waist to hip ratio.

According to the preferred embodiment of the invention, a user can use either a memory card 102 having eight kilobytes of memory or a memory card 102 having thirty-two kilobytes of memory. The memory on the eight kilobyte memory card 102 and the thirty-two kilobyte memory card 102 are preferably organized as shown in Tables 2 and 3 below. For both types of memory cards 102, a small portion of the memory reserved for machines and exercises is left available for further categories of data that a user may desire to store.

TABLE 2

Preferable Organization of Eight Kilobyte Memory Card

| Area | Quantity Detail | Bytes | Total |
|---|---|---|---|
| Card ID | 1 | | |
| | ID | 16 | 16 |
| Personal | 1 | | |
| | Type | 1 | |
| | User ID | 4 | |
| | Name | 59 | |
| | Total | | 64 |
| Machines | 64 | | |
| | Date | 4 | |
| | Starting | 2 | |
| | Intensity | 1 | |
| | Machine | 2 | |
| | Mode | 1 | |
| | Available | 2 | |
| | Total | | 12 |
| Exercises | 280 | | |
| | Date | 4 | |
| | Machine | 2 | |
| | Serial | 3 | |
| | Starting | 2 | |
| | Maximum | 2 | |
| | Total | 4 | |
| | Lifts | 2 | |
| | Trainer ID | 4 | |
| | Available | 3 | |
| | Total | | 26 |
| | Total Used | | 8128 |

TABLE 3

Preferable Organization of Thirty-Two Kilobyte Memory Card

| Area | Quantity Detail | Bytes | Total |
|---|---|---|---|
| Card ID | 1 | | |
| | ID | 16 | 16 |
| Personal | 1 | | |
| | Type | 1 | |
| | User ID | 4 | |
| | Name | 59 | |
| | Total | | 64 |
| Machines | 64 | | |
| | Date | 4 | |
| | Starting | 2 | |
| | Intensity | 1 | |
| | Machine | 2 | |
| | Mode | 1 | |
| | Available | 2 | |
| | Total | | 12 |

TABLE 3-continued

| Preferable Organization of Thirty-Two Kilobyte Memory Card | | | |
|---|---|---|---|
| Area | Quantity Detail | Bytes | Total |
| Exercises | 1200 | | |
| | Date | 4 | |
| | Machine | 2 | |
| | Serial | 3 | |
| | Starting | 2 | |
| | Maximum | 2 | |
| | Total | 4 | |
| | Lifts | 2 | |
| | Trainer ID | 4 | |
| | Available | 3 | |
| | Total | | 26 |
| Total Used | | | 31984 |

As shown in Tables 2, the eight kilobyte memory card 102 preferably stores data related to sixty-four machines and two hundred and eighty exercises. As shown in Table 3, the thirty-two kilobyte memory card 102 preferably stores data related to sixty-four machines and one thousand two hundred exercises. In both cases, the information related to individual exercises is preferably stored in a manner such that the first exercise to be recorded will be the first exercise to be recorded over, once the exercise portion of the memory is full. It should be realized that the amount of memory, the medium in which information is stored, and the organization of the memory may all be modified to suit numerous exercise related purposes.

A more detailed explanation of the operation of user interface console 94 and memory card 102 before and during exercise according to a preferred embodiment of the present invention is set forth in flow charts provided in FIGS. 16-21.

Figure 22:
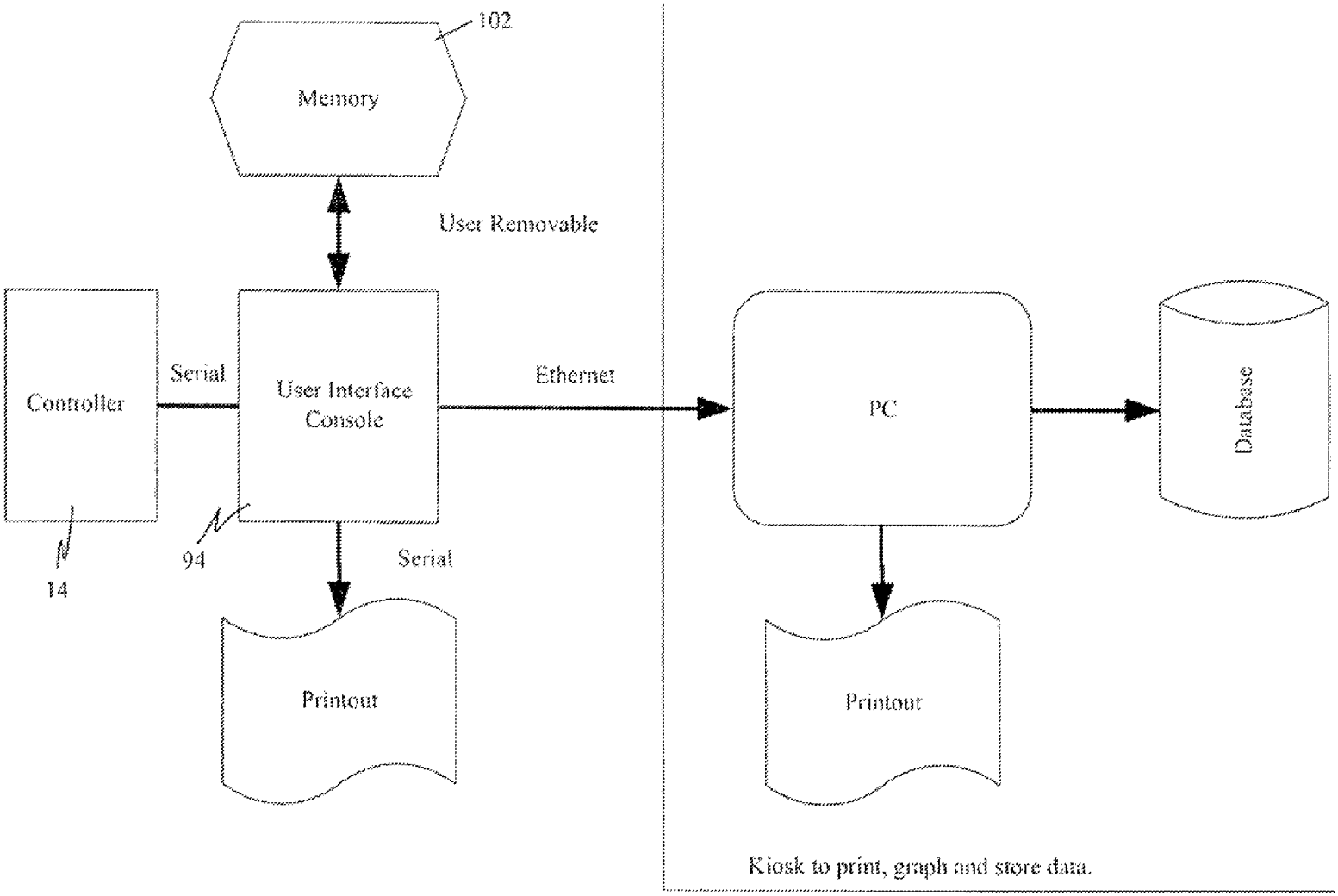
FIG. 22 is a diagram illustrating the connection of a user interface console with a computer and a database.

In an alternative embodiment depicted in FIG. 22 of the present invention, the user interface console 94 is networked with a kiosk having a centralized personal computer and database, which may be networked with user interface consoles from other exercise equipment in the area. Such networking may be accomplished through the use of such data transmission mediums as Ethernet, serial ports, or other mediums of information transfer. The networking of the user interfaces of multiple pieces of equipment could be used in many different manners. By way of example, and not by way of limitation, a gym can maintain a centralized database containing extensive workout information of its members. This information may be used by members, personal trainers, therapists or others to optimize exercise routines. Alternatively, algorithms can also be developed to automatically provide useful information to members or personal trainers related to a user's exercise routine. User interface consoles 94 may also be connected to printers, either directly or through a networking personal computer, to provide users with a printed copy of their exercise results.

In yet another embodiment of the present invention variable resistance system 12 is self powered, for example, by converting energy expended by a user into electrical energy used to power variable resistance system 12.

As will now be understood, the present two-part selector-lift mechanism which separates the lift plate and selectors from the actuator switches provides increased reliability by eliminating the condition in which the body of an actuator pin gets stuck or sheared in the opening of a lifting bar, as is common in the prior art. This shear condition has prevented the known mechanisms in automatically adjustable exercise machines from being reliable enough to be successfully commercialized. With the pin-less condition of the selector lift mechanism separated from actuator switches made possible through adjacently opposed magnets, the present invention represents a truly reliable and viable method by which to finally commercialize automatically adjustable exercise machines and control systems therefor.

As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents. For example, it is foreseen that the presently described and claimed resistance system will also be useful as a part of other machines, besides exercise equipment, such as may be desired in a wide variety of industries.

What is claimed is:

1. A method of providing variable resistance for an exercise device comprising the steps of:

providing a plurality of vertically oriented weights distributed horizontally and arranged in a side-by-side manner relative to each other, wherein said vertically oriented weights have a home position and a raised position;

receiving a command instruction at a computer controller from a user interface, wherein said command instruction corresponds with a starting weight; and controlling a set of actuators through said computer controller to select a corresponding set of said vertically oriented weights to match said starting weight, wherein said vertically oriented weights are selected independently from each other.

2. The invention of claim 1, further comprising the steps of:

defining a successful repetition as characterized by satisfying a criterion, wherein said criterion comprises a lift of said vertically oriented weights from said home position to said raised position;

determining through said computer controller a subsequent repetition of said lift does not satisfy said criterion;

automatically selecting a second set of vertically oriented weights having a second weight less than said starting weight following said subsequent repetition not satisfying said criterion.

3. The invention of claim 2, further comprising the steps of:

sensing said lift with a sensor;

communicating said sensed lift from said sensor to said computer controller;

determining in said computer controller a maximum lift range according to said sensed lift; and defining in said computer controller said criterion for said successful repetition as achieving a percentage of said maximum lift range.

4. The invention of claim 2, further comprising the steps of:

defining a set of intensity levels in said computer controller, wherein said intensity levels each of said intensity levels is comprised of at least one of a manual weight selection, a weight decrement percentage, and a weight increment percentage; and receiving an additional command instruction at said computer controller from said user interface selecting at least one of said intensity levels.

5. The invention of claim 4, further comprising the steps of:

determining through said computer controller that said subsequent repetition of said lift exceeds said criterion for said successful repetition;

redefining said successful repetition as characterized by satisfying said subsequent repetition exceeding said criterion; and automatically selecting a different set of vertically oriented weights having a different weight greater than said starting weight following said subsequent repetition exceeding said criterion according to said weight increment percentage.

6. The invention of claim 1, further comprising the steps of:

providing a selector assembly comprising a plurality of selectors, wherein said selectors are at least one of a set of tangs and a set of hooks; and controlling said set of actuators to apply or remove a force at a corresponding set of said selectors to disengage or engage said corresponding set of vertically oriented weights while said vertically oriented weights are proximate to said home position.

7. The invention of claim 6, further comprising the step of sensing said selector-engaged vertically oriented weights lifting from said home position to said raised position, wherein said actuators move with said selectors engaged with said vertically oriented weights between said home position and said raised position.

8. The invention of claim 6, further comprising the step of sensing said selector-engaged vertically oriented weights lifting from said home position to said raised position, wherein said actuators remain proximate to said home position while said selectors engaged with said vertically oriented weights move from said home position to said raised position.

9. The invention of claim 8, further comprising the steps of:

automatically determining a second set of vertically oriented weights having a second weight different from said starting weight;

repositioning said set of actuators after said selector-engaged vertically oriented weights have lifted from said home position, wherein said actuators apply or remove said force at a different set of selectors as said selector-engaged vertically oriented weights move back into said home position for a next repetition and wherein said different set of selectors disengage or engage a different set of said vertically oriented weights according to said second weight, wherein said home position has a vertical range proximate to a resting position of said vertically oriented weights in which said actuators can apply or remove said force at said corresponding set of said selectors.

10. The invention of claim 1, further comprising the steps of:

providing a manually operable member operatively connected to a lift plate through a lifting member;

attaching a selector assembly to said lift plate, wherein said selector assembly and said lift plate move between said home position and said raised position with said corresponding set of vertically oriented weights as said manually operable member is moved and wherein said selector assembly is comprised of a set of selector hooks;

controlling said set of actuators to apply or remove a force at a corresponding set of said selector hooks to disengage or engage said corresponding set of vertically oriented weights while said vertically oriented weights are proximate to said home position, wherein said computer controller causes an electric current to be sent to said set of actuators resulting in a movement of said actuators, wherein a position of said actuators is dissociated from said movement of said selector assembly and said lift plate, said position of said actuators remaining proximate to said home position while said selector assembly and said lift plate move between said home position and said raised position with said corresponding set of vertically oriented weights.

11. A method of providing variable resistance for an exercise machine comprising the steps of:

(a) providing a plurality of resistance providing members, a computer processor and at least one sensor in an operative measuring relationship with said resistance providing members and in operative communication with said computer processor, wherein said resistance providing members have a moveable position between a home position and a raised position;

(b) selecting a first set of resistance providing members from said plurality of resistance providing members having a first total resistance;

(c) sensing with said sensor a first lift of said first set of resistance providing members from said home position to said raised position;

(d) communicating said sensed first lift from said sensor to said computer processor;

(e) automatically defining in said computer processor a successful repetition as characterized by satisfying a success criterion corresponding with said first lift, wherein said success criterion is based on a full travel distance of said resistance providing members between said home position and said raised position;

(f) repeating steps (c) and (d) for at least one subsequent lift of said first set of resistance providing members selected from said plurality of resistance providing members, wherein said subsequent lift has a subsequent travel distance between said home position and said raised position;

(g) determining in said computer processor whether said subsequent lift meets said defined success criterion based on a comparison of said subsequent travel distance relative to said full travel distance;

(h) automatically determining in said computer processor a second set of resistance providing members having a second total resistance after said subsequent lift does not satisfy said success criterion, wherein the second total resistance is less than the first total resistance.

12. The invention of claim 11, further comprising the steps of:

determining in said computer processor a maximum lift range according to said sensed first lift, wherein said maximum lift range is a percentage of said full travel distance and wherein said full travel distance is a maximum travel sensed during said first lift; and defining in said computer processor said success criterion for said successful repetition as achieving said percentage of said maximum lift range with said subsequent travel distance.

13. The invention of claim 11, further comprising the steps of:

providing a plurality of vertically oriented weights arranged in a side-by-side manner relative to each other as said resistance providing members;

operatively connecting a manually operable member to a lift plate through a lifting member;

attaching a selector assembly to said lift plate, wherein said selector assembly and said lift plate move between said home position and said raised position with said vertically oriented weights as said manually operable member is moved and wherein said selector assembly is comprised of a plurality of selectors having an engaged position relative to said vertically oriented weights and a disengaged position relative to said vertically oriented weights, wherein said vertically oriented weights can be engaged by said selectors independently from each other;

providing a set of actuators in operative positioning relationship with said selectors; wherein a position of each actuator applies or removes a force at a corresponding selector and moves said selector between said engaged position and said disengaged position; and automatically selecting said second set of resistance providing members comprised of vertically oriented weights.

14. The invention of claim 13, wherein said automatic selection step is comprised of the steps:

determining in said computer processor said set of actuators and said set of selectors corresponding with second set of vertically oriented weights;

controlling in said computer processor an electric current sent to said set of actuators to move said actuators; and forcing said set of selectors between said engaged position and said disengaged position by said position of said actuators when said lift plate returns to said home position.

15. The invention of claim 13, wherein said selectors are comprised of at least one of a set of tangs and a set of hooks.

16. The invention of claim 13, wherein said actuators move with said selector assembly and said lift plate between said home position and said raised position.

17. The invention of claim 13, wherein said actuators do not move between said home position and said raised position, wherein said position of said actuators is dissociated from said movement of said selector assembly and said lift plate, said position of said actuators remaining proximate to said home position while said selector assembly and said lift plate move between said home position and said raised position with said corresponding set of vertically oriented weights.

18. The invention of claim 11 further comprising the steps:

defining a set of intensity levels in said computer controller, wherein each of said intensity levels is comprised of at least one of a manual weight selection, a weight decrement percentage, and a weight increment percentage;

receiving a first command instruction at said computer processor from a user interface, wherein said first command instruction corresponds with said first set of resistance providing members;

receiving a second command instruction at said computer controller from said user interface, wherein said second command instruction corresponds with at least one of said intensity levels;

determining in said computer processor that said subsequent lift exceeds said success criterion for said successful repetition;

redefining said success criterion as characterized by satisfying said subsequent lift exceeding said success criterion of said first lift; and automatically selecting a different set of resistance providing members having a different weight greater than said starting weight following said subsequent repetition exceeding said criterion according to said weight increment percentage.

19. A method of providing variable resistance for an exercise machine comprising the steps of:

(a) providing a plurality of resistance providing members, a computer processor and at least one sensor in an operative measuring relationship with said resistance providing members and in operative communication with said computer processor, wherein said resistance providing members have a moveable position between a home position and a raised position;

(b) selecting a first set of resistance providing members from said plurality of resistance providing members having a first total resistance;

(c) sensing with said sensor a first lift of said first set of resistance providing members from said home position to said raised position;

(d) communicating said sensed first lift from said sensor to said computer processor;

(e) automatically defining in said computer processor a successful repetition as characterized by satisfying a success criterion corresponding with said first lift;

(f) repeating steps (c) and (d) for at least one subsequent lift of said first set of resistance providing members selected from said plurality of resistance providing members;

(g) determining in said computer processor whether said subsequent lift meets said defined success criterion;

(h) automatically determining in said computer processor a second set of resistance providing members having a second total resistance after said subsequent lift does not satisfy said success criterion, wherein the second total resistance is less than the first total resistance;

(i) defining a set of intensity levels in said computer controller, wherein said intensity levels are comprised of at least one of a manual weight selection, a weight decrement percentage, and a weight increment percentage;

(j) receiving a first command instruction at said computer processor from a user interface, wherein said first command instruction corresponds with said first total resistance;

(k) receiving a second command instruction at said computer controller from said user interface, wherein said second command instruction corresponds with at least one of said intensity levels;

(l) determining in said computer processor that said subsequent lift exceeds said success criterion for said successful repetition;

(m) redefining said success criterion as characterized by satisfying said subsequent lift exceeding said success criterion of said first lift; and (n) automatically selecting a different set of resistance providing members having a different weight greater than said starting weight following said subsequent repetition exceeding said criterion according to said weight increment percentage.

* * * * *